US009005004B2

(12) United States Patent
Nicely

(10) Patent No.: US 9,005,004 B2
(45) **Date of Patent: *Apr. 14, 2015**

(54) GAMING SYSTEM, GAMING DEVICE, AND METHOD PROVIDING SELECTABLE DIFFERENT ROULETTE WHEELS FOR PLAY OF ROULETTE GAME

(75) Inventor: Mark C. Nicely, Daly City, CA (US)

(73) Assignee: IGT, Las Vegas, NV (US)

( * ) Notice: Subject to any disclaimer, the term of this patent is extended or adjusted under 35 U.S.C. 154(b) by 186 days.

This patent is subject to a terminal disclaimer.

(21) Appl. No.: 13/224,650

(22) Filed: Sep. 2, 2011

(65) Prior Publication Data

US 2013/0059638 A1 Mar. 7, 2013

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/322* (2013.01); *G07F 17/326* (2013.01); *G07F 17/34* (2013.01)

(58) Field of Classification Search

CPC ..... G07F 17/3213; G07F 17/322; G07F 17/3288; G07F 17/326; G07F 17/34; A63F 5/00; A63F 3/00157; A63F 5/0094; A63F 5/0005; A63F 5/045

USPC ..... 463/16–20

See application file for complete search history.

(56) References Cited

U.S. PATENT DOCUMENTS

| | | | |
|---|---|---|---|
| 1,578,412 | A | 3/1926 | Ewig |
| 3,628,259 | A | 12/1971 | Kahn |
| 3,819,186 | A | 6/1974 | Hinterstocker |
| 4,077,631 | A | 3/1978 | Tela, Sr. |
| 4,156,976 | A | 6/1979 | Mikun |
| 4,198,052 | A | 4/1980 | Gauselmann |
| 4,222,561 | A | 9/1980 | Whitten |
| 4,260,159 | A | 4/1981 | Hoffman |
| 4,337,945 | A | 7/1982 | Levy |
| 4,448,419 | A | 5/1984 | Telnaes |
| 4,621,814 | A | 11/1986 | Stepan et al. |
| 4,624,459 | A | 11/1986 | Kaufman |
| 4,652,998 | A | 3/1987 | Koza et al. |
| 4,669,731 | A | 6/1987 | Clarke |
| 4,695,053 | A | 9/1987 | Vazquez, Jr. et al. |

(Continued)

FOREIGN PATENT DOCUMENTS

| | | |
|---|---|---|
| AU | 199717601 B2 | 9/1997 |
| DE | 3105266 | 9/1982 |

(Continued)

*Primary Examiner* — Steve Rowland

(74) *Attorney, Agent, or Firm* — Neal, Gerber & Eisenberg LLP

(57) ABSTRACT

A gaming table, gaming system, gaming device, and gaming method that provide a roulette game having a plurality of different roulette wheels. For each play of the roulette game, one of the different roulette wheels is selected and employed in or for that play of the roulette game. When the player or players place their wagers, they do not know which of the different roulette wheels will be employed for that play of the roulette game. After the player or players place their wagers for the play of the roulette game, the selected roulette wheel for that play of the roulette game is indicated to the player or players, and the play of the roulette game commences using that indicated roulette wheel. Wagers placed on the play of the roulette game are settled or resolved based on the outcome on that indicated roulette wheel for that play of the game.

37 Claims, 11 Drawing Sheets

(56) References Cited

U.S. PATENT DOCUMENTS

| | | | |
|---|---|---|---|
| 4,732,386 | A | 3/1988 | Rayfiel |
| 4,805,907 | A | 2/1989 | Hagiwara |
| 4,836,546 | A | 6/1989 | DiRe et al. |
| 4,838,552 | A | 6/1989 | Hagiwara |
| 4,880,237 | A | 11/1989 | Kishita |
| 4,906,005 | A | 3/1990 | Manabe |
| 4,941,665 | A | 7/1990 | Klamer |
| 4,989,878 | A | 2/1991 | Davies |
| 4,991,848 | A | 2/1991 | Greenwood et al. |
| 5,011,159 | A | 4/1991 | Fortunato et al. |
| 5,019,973 | A | 5/1991 | Wilcox et al. |
| 5,046,735 | A | 9/1991 | Hamano et al. |
| 5,085,436 | A | 2/1992 | Bennett |
| 5,088,737 | A | 2/1992 | Frank et al. |
| 5,102,134 | A | 4/1992 | Smyth |
| 5,102,135 | A | 4/1992 | Addiechi |
| 5,116,055 | A | 5/1992 | Tracy |
| 5,123,649 | A | 6/1992 | Tiberio |
| 5,152,529 | A | 10/1992 | Okada |
| 5,167,413 | A | 12/1992 | Fulton |
| 5,184,821 | A | 2/1993 | Korenek |
| 5,197,736 | A | 3/1993 | Backus et al. |
| 5,224,706 | A | 7/1993 | Bridgeman et al. |
| 5,259,616 | A | 11/1993 | Bergmann |
| 5,294,120 | A | 3/1994 | Schultz |
| 5,294,128 | A | 3/1994 | Marquez |
| 5,308,065 | A | 5/1994 | Bridgeman et al. |
| 5,332,228 | A | 7/1994 | Schultz |
| 5,342,047 | A | 8/1994 | Heidel et al. |
| 5,344,144 | A | 9/1994 | Canon |
| 5,356,140 | A | 10/1994 | Dabrowski et al. |
| 5,375,830 | A | 12/1994 | Takemoto et al. |
| 5,377,973 | A | 1/1995 | Jones et al. |
| 5,393,057 | A | 2/1995 | Marnell, II |
| 5,393,061 | A | 2/1995 | Manship et al. |
| 5,395,111 | A | 3/1995 | Inoue |
| 5,397,125 | A | 3/1995 | Adams |
| 5,401,023 | A | 3/1995 | Wood |
| 5,407,200 | A | 4/1995 | Zalabak |
| 5,415,404 | A | 5/1995 | Joshi et al. |
| 5,423,539 | A | 6/1995 | Nagao |
| 5,431,408 | A | 7/1995 | Adams |
| 5,437,452 | A | 8/1995 | Graf et al. |
| 5,449,173 | A | 9/1995 | Thomas et al. |
| 5,456,465 | A | 10/1995 | Durham |
| 5,489,101 | A | 2/1996 | Moody |
| 5,511,781 | A | 4/1996 | Wood et al. |
| 5,531,448 | A | 7/1996 | Moody |
| 5,540,442 | A | 7/1996 | Orselli et al. |
| 5,542,669 | A | 8/1996 | Charron et al. |
| 5,553,851 | A | 9/1996 | Malavazos et al. |
| 5,560,603 | A | 10/1996 | Seelig et al. |
| 5,569,084 | A | 10/1996 | Nicastro et al. |
| 5,570,885 | A | 11/1996 | Ornstein |
| 5,580,055 | A | 12/1996 | Hagiwara |
| 5,584,486 | A | 12/1996 | Franklin |
| 5,584,763 | A | 12/1996 | Kelly et al. |
| 5,584,764 | A | 12/1996 | Inoue |
| 5,588,650 | A | 12/1996 | Eman et al. |
| 5,593,161 | A | 1/1997 | Boylan et al. |
| 5,611,535 | A | 3/1997 | Tiberio |
| 5,636,838 | A | 6/1997 | Caro |
| 5,639,089 | A | 6/1997 | Matsumoto et al. |
| 5,645,485 | A | 7/1997 | Clapper, Jr. |
| 5,647,798 | A | 7/1997 | Falciglia |
| 5,655,961 | A | 8/1997 | Acres et al. |
| 5,678,001 | A | 10/1997 | Nagel et al. |
| 5,707,285 | A | 1/1998 | Place et al. |
| 5,711,715 | A | 1/1998 | Ringo et al. |
| 5,718,431 | A | 2/1998 | Ornstein |
| 5,720,662 | A | 2/1998 | Holmes, Jr. et al. |
| 5,722,891 | A | 3/1998 | Inoue |
| 5,725,428 | A | 3/1998 | Achmuller |
| 5,732,950 | A | 3/1998 | Moody |
| 5,743,798 | A | 4/1998 | Adams et al. |
| 5,755,440 | A | 5/1998 | Sher |
| 5,766,074 | A | 6/1998 | Cannon et al. |
| 5,769,716 | A | 6/1998 | Saffari et al. |
| 5,770,533 | A | 6/1998 | Franchi |
| 5,772,506 | A | 6/1998 | Marks et al. |
| 5,772,509 | A | 6/1998 | Weiss |
| 5,775,692 | A | 7/1998 | Watts et al. |
| 5,788,573 | A | 8/1998 | Baerlocher et al. |
| 5,791,987 | A | 8/1998 | Chen et al. |
| 5,807,172 | A | 9/1998 | Piechowiak |
| 5,810,361 | A | 9/1998 | Kadlic |
| 5,816,916 | A | 10/1998 | Moody |
| 5,816,918 | A | 10/1998 | Kelly et al. |
| 5,817,172 | A | 10/1998 | Yamada et al. |
| 5,820,459 | A | 10/1998 | Acres et al. |
| 5,823,873 | A | 10/1998 | Moody |
| 5,823,874 | A | 10/1998 | Adams |
| D400,597 | S | 11/1998 | Hedrick et al. |
| 5,833,537 | A | 11/1998 | Barrie |
| 5,836,583 | A | 11/1998 | Towers |
| 5,848,932 | A | 12/1998 | Adams |
| 5,855,514 | A | 1/1999 | Kamille |
| 5,857,909 | A | 1/1999 | Rubin |
| 5,868,619 | A | 2/1999 | Wood et al. |
| 5,876,284 | A | 3/1999 | Acres et al. |
| 5,882,105 | A | 3/1999 | Barlow |
| 5,882,258 | A | 3/1999 | Kelly et al. |
| 5,882,261 | A | 3/1999 | Adams |
| 5,890,962 | A | 4/1999 | Takemoto |
| 5,902,184 | A | 5/1999 | Bennett |
| 5,910,048 | A | 6/1999 | Feinberg |
| 5,911,418 | A | 6/1999 | Adams |
| 5,918,880 | A | 7/1999 | Voigt, IV et al. |
| 5,934,672 | A | 8/1999 | Sines et al. |
| 5,934,999 | A | 8/1999 | Valdez |
| 5,935,002 | A | 8/1999 | Falciglia |
| 5,947,820 | A | 9/1999 | Morro et al. |
| 5,951,397 | A | 9/1999 | Dickinson |
| 5,954,335 | A | 9/1999 | Moody |
| 5,964,463 | A | 10/1999 | Moore, Jr. |
| 5,967,893 | A | 10/1999 | Lawrence et al. |
| 5,971,849 | A | 10/1999 | Falciglia |
| 5,976,016 | A | 11/1999 | Moody et al. |
| 5,980,384 | A | 11/1999 | Barrie |
| 5,984,310 | A | 11/1999 | English |
| 5,984,781 | A | 11/1999 | Sunaga |
| 5,984,782 | A | 11/1999 | Inoue |
| 5,988,638 | A | 11/1999 | Rodesch et al. |
| 5,993,316 | A | 11/1999 | Coyle et al. |
| 5,997,401 | A | 12/1999 | Crawford |
| 6,003,867 | A | 12/1999 | Rodesch et al. |
| 6,004,207 | A | 12/1999 | Wilson, Jr. et al. |
| 6,007,066 | A | 12/1999 | Moody |
| 6,007,424 | A | 12/1999 | Evers et al. |
| 6,012,720 | A | 1/2000 | Webb |
| 6,012,981 | A | 1/2000 | Fujioka et al. |
| 6,012,982 | A | 1/2000 | Piechowiak et al. |
| 6,012,983 | A | 1/2000 | Walker et al. |
| 6,032,955 | A | 3/2000 | Luciano et al. |
| 6,033,307 | A | 3/2000 | Vancura |
| 6,053,823 | A | 4/2000 | Mathews |
| 6,056,642 | A | 5/2000 | Bennett |
| 6,059,289 | A | 5/2000 | Vancura |
| 6,059,658 | A | 5/2000 | Mangano et al. |
| 6,059,659 | A | 5/2000 | Busch et al. |
| 6,062,980 | A | 5/2000 | Luciano |
| 6,062,981 | A | 5/2000 | Luciano, Jr. |
| 6,071,192 | A | 6/2000 | Weiss |
| 6,083,105 | A | 7/2000 | Ronin et al. |
| 6,089,977 | A | 7/2000 | Bennett |
| 6,089,978 | A | 7/2000 | Adams |
| 6,089,980 | A | 7/2000 | Gauselmann |
| 6,093,101 | A | 7/2000 | Mourad |
| 6,093,102 | A | 7/2000 | Bennett |
| 6,098,985 | A | 8/2000 | Moody |
| 6,102,400 | A | 8/2000 | Scott et al. |
| 6,102,402 | A | 8/2000 | Scott et al. |
| 6,102,798 | A | 8/2000 | Bennett |
| 6,105,962 | A | 8/2000 | Malavazos et al. |

(56) References Cited

U.S. PATENT DOCUMENTS 6,110,041 A 8/2000 Walker et al.
6,113,098 A 9/2000 Adams
6,120,031 A 9/2000 Adams
6,120,378 A 9/2000 Moody et al.
6,126,165 A 10/2000 Sakamoto
6,126,541 A 10/2000 Fuchs
6,126,542 A 10/2000 Fier
6,129,632 A 10/2000 Luciano
6,132,311 A 10/2000 Williams
6,135,884 A 10/2000 Hedrick et al.
6,142,872 A 11/2000 Walker et al.
6,142,873 A 11/2000 Weiss et al.
6,142,874 A 11/2000 Kodachi et al.
6,142,875 A 11/2000 Kodachi et al.
6,149,521 A 11/2000 Sanduski
6,155,925 A 12/2000 Giobbi et al.
6,158,741 A 12/2000 Koelling
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,522 B1 1/2001 Walker et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,179,711 B1 1/2001 Yoseloff
6,186,894 B1 2/2001 Mayeroff
6,190,254 B1 2/2001 Bennett
6,190,255 B1 2/2001 Thomas et al.
6,193,606 B1 2/2001 Walker et al.
6,196,547 B1 3/2001 Pascal et al.
6,203,429 B1 3/2001 Demar et al.
6,209,869 B1 4/2001 Mathews
6,210,277 B1 4/2001 Stefan
6,217,022 B1 4/2001 Astaneha
6,217,448 B1 4/2001 Olsen
6,220,959 B1 4/2001 Holmes, Jr. et al.
6,224,482 B1 5/2001 Bennett
6,224,483 B1 5/2001 Mayeroff
6,224,484 B1 5/2001 Okuda et al.
6,227,542 B1 5/2001 Cosmi
6,227,969 B1 5/2001 Yoseloff
6,227,971 B1 5/2001 Weiss
6,231,442 B1 5/2001 Mayeroff
6,231,445 B1 5/2001 Acres
6,234,897 B1 5/2001 Frohm et al.
6,238,287 B1 5/2001 Komori et al.
6,244,957 B1 6/2001 Walker et al.
6,251,013 B1 6/2001 Bennett
6,254,482 B1 7/2001 Walker et al.
6,264,200 B1 7/2001 Smith
6,270,409 B1 8/2001 Shuster
6,270,411 B1 8/2001 Gura et al.
6,270,412 B1 8/2001 Crawford et al.
6,290,600 B1 9/2001 Glasson
6,299,165 B1 10/2001 Nagano
6,299,170 B1 10/2001 Yoseloff
6,302,398 B1 10/2001 Vecchio
6,302,790 B1 10/2001 Brossard
6,302,791 B1 10/2001 Frohm et al.
6,305,686 B1 10/2001 Perrie et al.
6,309,299 B1 10/2001 Weiss
6,311,976 B1 11/2001 Yoseloff et al.
6,312,331 B1 11/2001 Tamaki
6,312,334 B1 11/2001 Yoseloff
6,315,660 B1 11/2001 DeMar et al.
6,315,662 B1 11/2001 Jorasch et al.
6,315,663 B1 11/2001 Sakamoto
6,319,124 B1 11/2001 Baerlocher et al.
6,322,078 B1 11/2001 Adams
6,336,860 B1 1/2002 Webb
6,336,862 B1 1/2002 Byrne
6,336,863 B1 1/2002 Baerlocher et al.
6,340,158 B2 1/2002 Price et al.
6,352,260 B1 3/2002 Santiago
6,358,144 B1 3/2002 Kaddlic et al.
6,358,147 B1 3/2002 Jaffe et al.
6,364,314 B1 4/2002 Canterbury
6,364,766 B1 4/2002 Anderson et al.
6,364,768 B1 4/2002 Acres et al.
6,368,214 B1 4/2002 Luciano
6,375,569 B1 4/2002 Acres
6,375,570 B1 4/2002 Poole
6,394,902 B1 5/2002 Glavich et al.
6,398,218 B1 6/2002 Vancura
6,398,220 B1 6/2002 Inoue
6,398,644 B1 6/2002 Perrie et al.
6,413,162 B1 7/2002 Baerlocher et al.
6,413,163 B1 7/2002 Yamauchi et al.
6,419,579 B1 7/2002 Bennett
6,428,412 B1 8/2002 Anderson et al.
6,435,968 B1 8/2002 Torango
6,439,943 B1 8/2002 Aoki et al.
6,439,993 B1 8/2002 O'Halloran
6,439,995 B1 8/2002 Hughs-Baird et al.
6,443,452 B1 9/2002 Brune
6,443,456 B1 9/2002 Gajor
6,450,884 B1 9/2002 Seelig et al.
6,454,266 B1 9/2002 Breeding et al.
6,461,241 B1 10/2002 Webb et al.
6,467,770 B1 10/2002 Matosevic
6,471,208 B2 10/2002 Yoseloff et al.
6,481,713 B2 11/2002 Perrie et al.
6,491,584 B2 12/2002 Graham et al.
6,494,454 B2 12/2002 Adams
6,497,409 B2 12/2002 Mathews
6,517,432 B1 2/2003 Jaffe
6,520,503 B1 2/2003 Porto
6,520,854 B1 2/2003 McNally
6,537,150 B1 3/2003 Luciano et al.
6,537,152 B2 3/2003 Seelig et al.
6,551,187 B1 4/2003 Jaffe
6,561,512 B2 5/2003 Luciano et al.
6,561,904 B2 5/2003 Locke et al.
6,565,436 B1 5/2003 Baerlocher
6,568,680 B1 5/2003 Moody et al.
6,569,013 B1 5/2003 Taylor
6,575,834 B1 6/2003 Lindo
6,599,185 B1 7/2003 Kaminkow et al.
6,599,193 B2 7/2003 Baerlocher et al.
6,602,136 B1 8/2003 Baerlocher et al.
6,602,137 B2 8/2003 Kaminkow et al.
6,604,740 B1 8/2003 Singer et al.
6,609,969 B1 8/2003 Luciano et al.
6,609,970 B1 8/2003 Juciano, Jr.
6,612,927 B1 9/2003 Slomiany et al.
6,616,142 B2 9/2003 Adams
6,632,139 B1 10/2003 Baerlocher
6,632,140 B2 10/2003 Berman et al.
6,634,942 B2 10/2003 Walker et al.
6,634,945 B2 10/2003 Glavich et al.
6,652,378 B2 11/2003 Cannon et al.
6,656,043 B2 12/2003 Seelig et al.
6,659,462 B1 12/2003 Scott
6,659,866 B2 12/2003 Frost et al.
6,663,106 B1 12/2003 Cosmi
6,682,073 B2 1/2004 Bryant et al.
6,695,696 B1 2/2004 Kaminkow
6,702,667 B2 3/2004 Mattice et al.
6,712,693 B1 3/2004 Hettinger
6,712,694 B1 3/2004 Nordman
6,712,695 B2 3/2004 Mothwurf et al.
6,722,858 B2 4/2004 Yoshimura et al.
6,726,563 B1 4/2004 Baerlocher et al.
6,733,385 B1 5/2004 Enzminger et al.
6,733,389 B2 5/2004 Webb et al.
6,739,970 B2 5/2004 Luciano
6,758,749 B2 7/2004 Krintzman
6,764,396 B2 7/2004 Seelig et al.
6,776,711 B1 8/2004 Baerlocher
6,780,105 B1 8/2004 Kaminkow

(56) References Cited

U.S. PATENT DOCUMENTS 6,786,824 B2 9/2004 Cannon
6,802,778 B1 10/2004 Lemay et al.
6,805,349 B2 10/2004 Baerlocher et al.
6,811,483 B1 11/2004 Webb et al.
6,857,957 B2 2/2005 Marks et al.
6,869,359 B1 3/2005 Mathews
6,869,360 B2 3/2005 Marks et al.
6,878,061 B2 4/2005 Baerlocher
6,884,167 B2 4/2005 Walker et al.
6,890,255 B2 5/2005 Jarvis et al.
6,890,257 B2 5/2005 Baerlocher
6,899,620 B2 5/2005 Kaminkow et al.
6,905,406 B2 6/2005 Kaminkow et al.
6,908,383 B2 6/2005 Baerlocher et al.
6,913,532 B2 7/2005 Baerlocher et al.
6,921,072 B2 7/2005 Hughes-Watts
6,921,335 B2 7/2005 Rodgers et al.
6,923,720 B2 8/2005 Loose
6,926,607 B2 8/2005 Slomiany et al.
6,929,952 B2 8/2005 Baerlocher
6,955,600 B2 10/2005 Glavich et al.
6,960,133 B1 11/2005 Marks et al.
6,988,731 B2 1/2006 Inoue
6,991,544 B2 1/2006 Soltys et al.
7,001,274 B2 2/2006 Baerlocher et al.
7,008,324 B1 3/2006 Johnson et al.
7,014,560 B2 3/2006 Glavich et al.
7,029,395 B1 4/2006 Baerlocher
7,052,395 B2 5/2006 Glavich et al.
7,066,814 B2 6/2006 Glavich et al.
7,094,150 B2 8/2006 Ungaro et al.
7,121,943 B2 10/2006 Webb et al.
7,160,188 B2 1/2007 Kaminkow et al.
7,204,488 B2 4/2007 Ilievski
RE39,659 E 5/2007 Luciano et al.
7,216,867 B1 5/2007 Luciano et al.
7,306,520 B2 12/2007 Kaminkow et al.
7,329,187 B1 2/2008 Holch et al.
7,425,177 B2 9/2008 Rodgers et al.
7,533,233 B2 5/2009 Berlin
7,533,885 B2 5/2009 Nicely et al.
7,594,851 B2 9/2009 Falconer
7,674,172 B2 3/2010 Miltenberger et al.
7,708,630 B2 5/2010 Nicely
7,850,171 B2 12/2010 Bontempo et al.
7,901,280 B2 3/2011 Jarvis et al.
2001/0003709 A1 6/2001 Adams
2001/0005690 A1 6/2001 Boulton
2001/0009865 A1 7/2001 Demar et al.
2001/0015525 A1 8/2001 Mathews
2001/0018361 A1 8/2001 Acres
2001/0022429 A1 9/2001 Luciano et al.
2001/0023199 A1 9/2001 Walker et al.
2001/0038178 A1 11/2001 Vancura
2002/0010014 A1 1/2002 Parra et al.
2002/0010017 A1 1/2002 Bennett
2002/0052233 A1 5/2002 Gauselmann
2002/0086725 A1 7/2002 Fasbender et al.
2002/0137559 A1 9/2002 Baerlocher
2002/0165023 A1 11/2002 Brosnan et al.
2002/0167126 A1 11/2002 Herman De Raedt et al.
2002/0169017 A1 11/2002 Visoenik
2002/0187827 A1 12/2002 Blankstein
2002/0193160 A1 12/2002 Tarantino
2003/0025211 A1 2/2003 Wilday et al.
2003/0027623 A1 2/2003 Rose
2003/0050110 A1 3/2003 Wichinsky
2003/0054873 A1 3/2003 Peterson
2003/0060266 A1 3/2003 Baerlocher
2003/0060269 A1 3/2003 Paulsen et al.
2003/0060272 A1 3/2003 Glavich et al.
2003/0060281 A1 3/2003 Vancura
2003/0069062 A1 4/2003 Shimizu
2003/0069063 A1 4/2003 Bilyeu et al.
2003/0073483 A1 4/2003 Glavich et al.
2003/0092480 A1 5/2003 White et al.
2003/0092490 A1 5/2003 Gauselmann
2003/0094752 A1 5/2003 Mathews et al.
2003/0098543 A1 5/2003 Porto
2003/0153383 A1 8/2003 Baerlocher et al.
2003/0155708 A1 8/2003 Perrie et al.
2003/0162585 A1 8/2003 Bigelow et al.
2003/0195031 A1 10/2003 O'Donovan et al.
2003/0203753 A1 10/2003 Muir et al.
2003/0207713 A1 11/2003 Taylor
2003/0216165 A1 11/2003 Singer et al.
2003/0232651 A1 12/2003 Huard et al.
2004/0002372 A1 1/2004 Rodgers et al.
2004/0017043 A1 1/2004 Moody
2004/0038731 A1 2/2004 Englman
2004/0048650 A1 3/2004 Mierau et al.
2004/0048652 A1 3/2004 Ching et al.
2004/0053666 A1 3/2004 Vancura
2004/0053669 A1 3/2004 Gerrard et al.
2004/0053672 A1 3/2004 Baerlocher
2004/0061285 A1* 4/2004 Hughes-Watts ..... 273/143 R
2004/0063493 A1 4/2004 Baerlocher
2004/0072609 A1 4/2004 Ungaro et al.
2004/0072612 A1 4/2004 Rodgers et al.
2004/0077398 A1* 4/2004 Jarvis et al. ..... 463/17
2004/0102244 A1 5/2004 Kryuchkov et al.
2004/0116177 A1 6/2004 Frost et al.
2004/0137982 A1 7/2004 Cuddy et al.
2004/0147306 A1 7/2004 Randall et al.
2004/0152500 A1 8/2004 Baerlocher
2004/0159590 A1 8/2004 Mothwurf
2004/0162129 A1 8/2004 Nelson
2004/0162130 A1 8/2004 Walker et al.
2004/0166942 A1 8/2004 Muir
2004/0176156 A1 9/2004 Walker et al.
2004/0212150 A1 10/2004 Huard et al.
2004/0219969 A1 11/2004 Casey et al.
2004/0242302 A1 12/2004 Baerlocher
2004/0242315 A1 12/2004 Paulsen et al.
2004/0251624 A1 12/2004 Hodapp et al.
2004/0254011 A1 12/2004 Muskin
2004/0256804 A1 12/2004 Huard et al.
2004/0266510 A1 12/2004 Kojima
2004/0266512 A1 12/2004 Kaminkow
2004/0266516 A1 12/2004 Bleich et al.
2004/0266517 A1 12/2004 Thomas
2005/0014550 A1 1/2005 Rhoten
2005/0020346 A1 1/2005 Baerlocher
2005/0029745 A1 2/2005 Walker et al.
2005/0037838 A1 2/2005 Dunaevsky et al.
2005/0049035 A1 3/2005 Baerlocher et al.
2005/0054429 A1 3/2005 Baerlocher et al.
2005/0059481 A1 3/2005 Joshi et al.
2005/0060050 A1 3/2005 Baerlocher
2005/0070354 A1 3/2005 Baerlocher et al.
2005/0075163 A1 4/2005 Cuddy et al.
2005/0079911 A1 4/2005 Nakatsu
2005/0090306 A1 4/2005 Seelig et al.
2005/0130737 A1 6/2005 Englman et al.
2005/0176494 A1 8/2005 Thomas
2005/0192076 A1 9/2005 Lowery
2005/0192079 A1 9/2005 Lowery
2005/0215307 A1 9/2005 Jarvis et al.
2005/0215311 A1 9/2005 Hornik et al.
2005/0218590 A1 10/2005 O'Halloran et al.
2005/0233796 A1 10/2005 Baerlocher et al.
2005/0233801 A1 10/2005 Baerlocher et al.
2005/0233803 A1 10/2005 Yang
2005/0255904 A1 11/2005 Duhamel
2005/0282615 A1 12/2005 Englman et al.
2005/0282629 A1 12/2005 Gagner
2005/0285336 A1 12/2005 Ilievski
2005/0285337 A1 12/2005 Durham et al.
2006/0003834 A1 1/2006 Okada
2006/0009283 A1 1/2006 Englman et al.
2006/0009286 A1 1/2006 Durham et al.
2006/0014580 A1 1/2006 Hawthorn
2006/0019744 A1 1/2006 Roemer
2006/0025193 A1 2/2006 Gail et al.

(56) References Cited

U.S. PATENT DOCUMENTS

| | | | | |
|---|---|---|---|---|
| 2006/0025211 | A1 | 2/2006 | Wilday et al. | |
| 2006/0046833 | A1 | 3/2006 | Hatakeyama et al. | |
| 2006/0066044 | A1* | 3/2006 | Dabosh | 273/139 |
| 2006/0069619 | A1 | 3/2006 | Walker et al. | |
| 2006/0073873 | A1 | 4/2006 | Rodgers et al. | |
| 2006/0073897 | A1 | 4/2006 | Englman et al. | |
| 2006/0094495 | A1 | 5/2006 | Gelber et al. | |
| 2006/0157927 | A1 | 7/2006 | O'Halloran et al. | |
| 2006/0157928 | A1 | 7/2006 | O'Halloran | |
| 2006/0170154 | A1 | 8/2006 | Matsuno et al. | |
| 2006/0170155 | A1 | 8/2006 | Silverman | |
| 2006/0178191 | A1* | 8/2006 | Ellis | 463/17 |
| 2006/0205480 | A1 | 9/2006 | Glavich et al. | |
| 2006/0217174 | A1 | 9/2006 | Walker et al. | |
| 2006/0237905 | A1* | 10/2006 | Nicely et al. | 273/274 |
| 2006/0246989 | A1 | 11/2006 | Glavich et al. | |
| 2006/0249899 | A1 | 11/2006 | Lease | |
| 2006/0287034 | A1 | 12/2006 | Englman et al. | |
| 2006/0287053 | A1 | 12/2006 | Yokota | |
| 2007/0021182 | A1 | 1/2007 | Gauselmann | |
| 2007/0057452 | A1 | 3/2007 | Dargue | |
| 2007/0060262 | A1 | 3/2007 | Kosaka et al. | |
| 2007/0060292 | A1 | 3/2007 | Peterson | |
| 2007/0069459 | A1 | 3/2007 | Vidondo | |
| 2007/0075488 | A1 | 4/2007 | Pececnik | |
| 2007/0135203 | A1* | 6/2007 | Nicely | 463/17 |
| 2007/0135204 | A1 | 6/2007 | Nicely | |
| 2008/0076503 | A1 | 3/2008 | Mattice et al. | |
| 2008/0146311 | A1 | 6/2008 | Walker et al. | |
| 2009/0104963 | A1 | 4/2009 | Burman et al. | |
| 2010/0120487 | A1* | 5/2010 | Walker et al. | 463/17 |
| 2010/0144419 | A1 | 6/2010 | Miltenberger et al. | |
| 2010/0227665 | A1 | 9/2010 | Nicely | |
| 2011/0039613 | A1 | 2/2011 | Bontempo et al. | |
| 2011/0111824 | A1 | 5/2011 | Cuddy et al. | |
| 2011/0111828 | A1 | 5/2011 | Caputo et al. | |
| 2012/0202575 | A1* | 8/2012 | Matsuno | 463/17 |
| 2012/0238343 | A1* | 9/2012 | Perrone et al. | 463/17 |

FOREIGN PATENT DOCUMENTS

| | | | |
|---|---|---|---|
| DE | 8710757 | | 11/1987 |
| DE | 3716849 | | 12/1988 |
| DE | 19600787 | | 5/1997 |
| DE | 19613455 | | 8/1997 |
| DE | 19936196 | | 1/2001 |
| EP | 60 019 | A1 | 9/1982 |
| EP | 0 558 307 | A2 | 2/1993 |
| EP | 0 753 331 | A2 | 1/1997 |
| EP | 0 874 337 | A1 | 10/1998 |
| EP | 0 926 645 | A2 | 6/1999 |
| EP | 0 945 837 | A2 | 9/1999 |
| EP | 0 981 119 | A2 | 2/2000 |
| EP | 0 984 407 | A2 | 3/2000 |
| EP | 0 984 408 | A2 | 3/2000 |
| EP | 0 989 531 | A2 | 3/2000 |
| EP | 1 076 321 | A1 | 2/2001 |
| EP | 1 195 730 | A2 | 4/2002 |
| EP | 1 226 851 | | 7/2002 |
| EP | 1 513 114 | A2 | 3/2005 |
| EP | 1 513 116 | A2 | 3/2005 |
| EP | 1 513 117 | A2 | 3/2005 |
| EP | 1 536 388 | A1 | 6/2005 |
| EP | 1 580 701 | A2 | 9/2005 |
| EP | 1 589 501 | A1 | 10/2005 |
| EP | 1 710 000 | | 10/2006 |
| EP | 1 721 642 | | 11/2006 |
| EP | 1 769 828 | | 4/2007 |
| GB | 970806 | | 9/1964 |
| GB | 2 101 380 | A | 1/1983 |
| GB | 2 137 392 | A | 10/1984 |
| GB | 2 262 642 | A | 6/1993 |
| GB | 2 292 245 | | 2/1996 |
| GB | 2 354 179 | | 5/1997 |
| GB | 2 371 494 | | 8/1997 |
| GB | 2 322 217 | | 8/1998 |
| GB | 2322217 | | 1/2001 |
| GB | 2 354 179 | | 3/2001 |
| GB | 2358591 | | 8/2001 |
| GB | 2 371 494 | | 7/2002 |
| GB | 2 382 911 | | 6/2003 |
| GB | 2 387 950 | A | 10/2003 |
| GB | 2395139 | | 5/2004 |
| GB | 2 431 362 | | 4/2007 |
| JP | 60099278 | A | 6/1985 |
| WO | WO 85/00910 | | 2/1985 |
| WO | WO 97 32285 | | 9/1997 |
| WO | WO 9738766 | | 10/1997 |
| WO | WO 98/00207 | | 1/1998 |
| WO | WO 99/03078 | | 1/1999 |
| WO | WO 00/32286 | | 6/2000 |
| WO | WO 00/33269 | | 6/2000 |
| WO | WO 00/66235 | | 11/2000 |
| WO | WO 00/76606 | A1 | 12/2000 |
| WO | WO 01/26019 | A1 | 4/2001 |
| WO | WO 02/056984 | | 7/2002 |
| WO | WO 02/078804 | | 10/2002 |
| WO | WO 03/026757 | | 4/2003 |
| WO | WO 2004/023400 | A1 | 3/2004 |
| WO | WO 2004/025584 | | 3/2004 |
| WO | WO 2005/077480 | | 8/2005 |
| WO | WO 2005/083599 | | 9/2005 |
| WO | WO 2006/015442 | | 2/2006 |
| WO | WO 2006/061616 | | 6/2006 |
| WO | WO 2006/078219 | | 7/2006 |
| WO | WO 2006/094398 | | 9/2006 |
| WO | WO 2006/097007 | | 9/2006 |
| WO | WO 2007/024202 | | 3/2007 |
| WO | WO 2007/033430 | | 3/2007 |
| WO | WO 2007/077449 | A1 | 7/2007 |

* cited by examiner

GAMING SYSTEM, GAMING DEVICE, AND METHOD PROVIDING SELECTABLE DIFFERENT ROULETTE WHEELS FOR PLAY OF ROULETTE GAME

CROSS REFERENCE TO RELATED APPLICATIONS

This application relates to the following co-pending commonly owned patent application: "GAMING SYSTEM, GAMING DEVICE, AND METHOD PROVIDING SELECTABLE DIFFERENT ROULETTE WHEELS FOR PLAY OF ROULETTE GAME," U.S. patent application Ser. No. 13/224,644.

COPYRIGHT NOTICE

A portion of the disclosure of this patent document contains material which is subject to copyright protection. The copyright owner has no objection to the photocopy reproduction of the patent document or the patent disclosure in exactly the form it appears in the Patent and Trademark Office patent file or records, but otherwise reserves all copyright rights whatsoever.

BACKGROUND

There are a variety of wagering games to play in physical casinos, online casinos, and other gaming environments. Roulette is one commonly known wagering game that includes a moving wheel having a plurality of numbered and colored wells or ball landings and a ball that travels along the moving wheel. Depending upon in which of the wells or ball landings the ball stops or lands, the player may win or lose on each of one or more wagers. There is a continuing need to increase the level of interest, excitement, hit frequency, and volatility associated with playing roulette wagering games. There is also a continuing need to enhance the operational functionality of roulette wagering games or otherwise provide improvements to, and interesting variations of, roulette wagering games.

SUMMARY

Various embodiments of the present disclosure relate to a gaming table, gaming system, gaming device, and gaming method that provide a roulette game having a plurality of different selectable roulette wheels. Each of the different selectable roulette wheels includes a plurality of different outcomes. After a player or players place one or more wagers associated with one or more of the outcomes for a play of the roulette game, one of the different selectable roulette wheels that will be employed in that specific play of the roulette game is indicated to the player or players. The play of the roulette game commences using that indicated roulette wheel, and one of the outcomes of that indicated roulette wheel is determined. Each of the wagers placed on that play of the roulette game is settled or resolved based on the determined outcome of that indicated roulette wheel (i.e., based on where the ball lands on that indicated roulette wheel). In various embodiments, the selection or determination of which of the different selectable roulette wheels is employed in each play of the roulette game is a random selection or determination. While this random selection or determination may take place before or after a player or players place any wagers on a play of the roulette game, in this embodiment the random selection or determination of which of the different selectable roulette wheels will be employed for a play of the roulette game is not indicated to the player or players until after the player or players have placed any wagers on that specific play of the roulette game. Thus, when the player or players place one or more wagers on a play of the roulette game, the player or players do not know which of the different selectable roulette wheels will be employed for that specific play of the roulette game.

The present disclosure contemplates that one or more of the different selectable roulette wheels include non-standard well values. For example: (1) one or more of the different selectable roulette wheels include one or more additional numbered red wells; (2) one or more of the different selectable roulette wheels include one or more additional unnumbered red wells; (3) one or more of the different selectable roulette wheels include one or more additional numbered black wells; (4) one or more of the different selectable roulette wheels include one or more additional unnumbered black wells; (5) one or more of the different selectable roulette wheels include one or more additional wells numbered with high numbers (such as numbers greater than or equal to 19); (6) one or more of the different selectable roulette wheels include one or more additional wells numbered with low numbers (such as numbers less than 19); (7) one or more of the different selectable roulette wheels include one or more additional wells numbered with lower third numbers (such as numbers between 1 and 12, inclusive); (8) one or more of the different selectable roulette wheels include one or more additional wells numbered with middle third numbers (such as numbers between 13 and 24, inclusive); (9) one or more of the different selectable roulette wheels include one or more additional wells numbered with upper third numbers (such as numbers between 25 and 36, inclusive); (10) one or more of the different selectable roulette wheels include one or more additional wells numbered with odd numbers; and (11) one or more of the different selectable roulette wheels include one or more additional wells numbered with even numbers.

In other examples: (1) one or more of the different selectable roulette wheels include one or more numbered red wells that are larger or smaller than one or more other wells; (2) one or more of the different selectable roulette wheels include one or more unnumbered red wells that are larger or smaller than one or more other wells; (3) one or more of the different selectable roulette wheels include one or more numbered black wells that are larger or smaller than one or more other wells; (4) one or more of the different selectable roulette wheels include one or more unnumbered black wells that are larger or smaller than one or more other wells; (5) one or more of the different selectable roulette wheels include one or more wells numbered with high numbers (such as numbers greater than or equal to 19) that are larger or smaller than one or more other wells; (6) one or more of the different selectable roulette wheels include one or more wells numbered with low numbers (such as numbers less than 19) that are larger or smaller than one or more other wells; (7) one or more of the different selectable roulette wheels include one or more wells numbered with lower third numbers (such as numbers between 1 and 12, inclusive) that are larger or smaller than one or more other wells; (8) one or more of the different selectable roulette wheels include one or more wells numbered with middle third numbers (such as numbers between 13 and 24, inclusive) that are larger or smaller than one or more other wells; (9) one or more of the different selectable roulette wheels include one or more wells numbered with upper third numbers (such as numbers between 25 and 36, inclusive); (10) one or more of the different selectable roulette wheels include one or more wells numbered with odd numbers that are larger or smaller than one or more other wells; and (11) one or more of the different selectable roulette wheels include one or more wells numbered with even numbers that are larger or smaller than one or more other wells.

The present disclosure thus contemplates that the addition of wells (such as additional red wells) to a standard roulette wheel (such as a standard European or American roulette wheel) may be accomplished either by: (a) adding wells to the standard roulette wheel; (b) replacing wells of the standard roulette wheel with other, different wells (such as replacing one or more black wells with one or more red wells); (c) changing the sizes of two or more of the wells; and/or (d) any combination of these variations. In embodiments where the addition of one or more wells or the change of size of one or more wells comes at the expense of certain other wells, the total number of wells on the standard roulette wheel remains constant to configure the different roulette wheel. While certain embodiments of the present disclosure contemplate eliminating one or more wells to make room for additional wells on one or more of the different selectable roulette wheels, it should be appreciated that various embodiments of the present disclosure do not eliminate wells and thus do not eliminate all chances for a player to win on a wager associated with an outcome that is based on or associated with any given well. In other words, since the player places one or more wagers, and then learns which of the different selectable roulette wheels will be employed, these various embodiments of the present disclosure contemplate that the player may still have a chance, even if that chance is reduced, to win on each and every wager placed by the player.

The present disclosure contemplates that this roulette game with multiple different selectable roulette wheels may be played at a gaming table with a live dealer, at a gaming table with a virtual or a video dealer, through a gaming system with a live dealer and player specific bet stations, through a stand alone gaming device, through a computer network such as the internet, or in any other suitable manner. In various embodiments, the roulette game is administered by a dealer which may or may not be: a human dealer and, more specifically a human dealer operating in a casino, a feed or transmission of a video of a dealer operating in a live game, or through a real-time video feed of a live casino game; a computerized dealer; a virtual dealer of a casino; a gaming device; a processor; a gaming establishment; or a gaming system provided through a data network such as the internet.

It is therefore an advantage of the present disclosure to provide a roulette game with multiple different selectable roulette wheels that increases the level of player interest and excitement.

Additional features and advantages are described herein, and will be apparent from, the following Detailed Description and the Figures.

DETAILED DESCRIPTION

Figure 1:
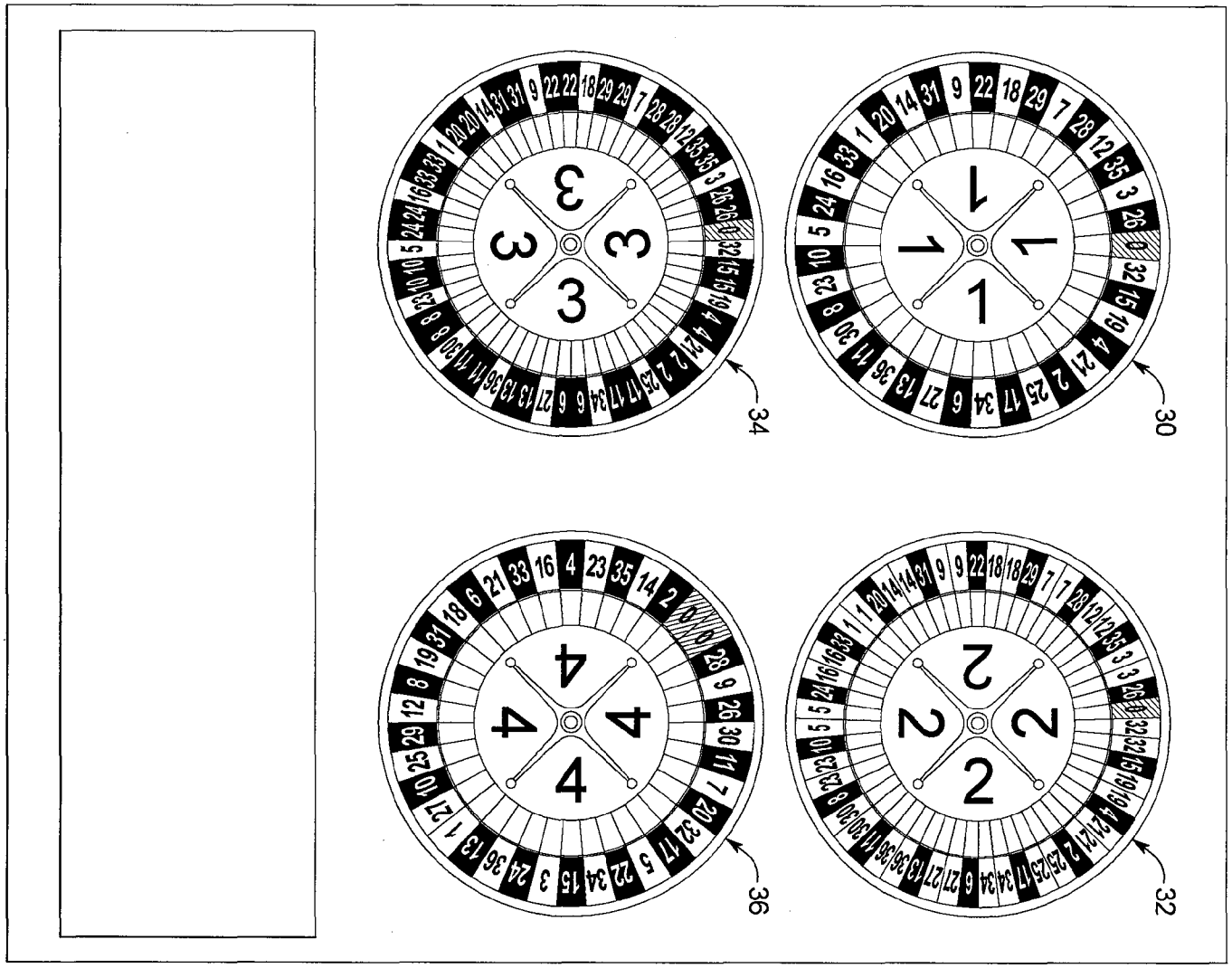
FIG. 1 is a front view of a display of a set of four different selectable roulette wheels of a roulette game of one example embodiment of the present disclosure.

The present disclosure relates to a gaming table, gaming system, gaming device, and gaming method that provide a roulette game having a plurality of different selectable roulette wheels. Each of the different selectable roulette wheels includes a plurality of outcomes. One or more players may place one or more wagers associated with one or more of the outcomes of the different selectable roulette wheels. For example, a standard European roulette wheel includes thirty-seven outcomes, each of which has a color (red, black, or green) and a corresponding number (1 through 36, inclusive, and 0). The outcomes correspond to the wells of the roulette wheel such that each well is associated with a different one of the outcomes. In a play of a roulette game utilizing the standard European roulette wheel, the player may, for example, place one or more of the following wagers (among others not listed above) associated with the outcomes: (a) a color wager on one of the colors (e.g., red or black); (b) a number wager on one of the numbers (e.g., 1 through 36, inclusive, and 0); (c) an odd number wager on all of the odd numbers (i.e., all of the odd numbers between 1 through 36, inclusive); and (d) an even number wager on all of the even numbers (i.e., all of the even numbers between 1 and 36, inclusive). The outcome of the play of the roulette game is used to determine whether the player wins the player's wager. For example, if the player placed a number wager on 33 and a color wager on black, and the outcome of the roulette game is 33 BLACK, the player wins both the number wager and the color wager.

Generally, for each play of the roulette game of the present disclosure, one of the different selectable roulette wheels is selected and employed in or for that play of the roulette game. While this selection may take place before or after a player or players place their wagers on that specific play of the roulette game, in this embodiment the selection of which of the different selectable roulette wheels will be employed for that specific play of the roulette game is not indicated to the player or players until after the player or players have placed any wagers on that specific play of the roulette game. Thus, when the player or players place one or more wagers on a play of the roulette game, they do not know which of the different selectable roulette wheels will be employed for that specific play of the roulette game. After the player or players place their wagers on a play of the roulette game, the selected different selectable roulette wheel for that specific play of the roulette game is indicated to the player or players, and the play of the roulette game commences using that indicated roulette wheel. One of the outcomes of that indicated roulette wheel is determined. Each of the wagers placed on that play of the roulette game is settled or resolved based on the determined outcome of that indicated roulette wheel for that specific play of the roulette game.

The present disclosure contemplates that the selection or determination of which of the different selectable roulette wheels is employed in each play of the game is preferably a random selection or determination. In various embodiments, this random selection or determination is made by a processor. In other embodiments, this random selection or determination is made by a person (such as a player or dealer) using, for example, a mechanical random outcome generator. In various other examples, a player or a dealer may spin a wheel, select a face down tile, deal a card, or roll a die to determine which of the different selectable roulette wheels will be used for that play of the game. It should also be appreciated that the present disclosure contemplates that the selection of which of the different selectable roulette wheels will be used in a play of the roulette game may be determined in any other suitable manner, such as based on one or more predetermined patterns. In such pattern-based embodiments, the player or players preferably would not know the pattern employed.

In certain embodiments, each of the different selectable roulette wheels has the same probability of being selected in each play of the game. In one example embodiment, each of six different selectable roulette wheels is associated with a different number between 1 and 6, inclusive. In this example, each of the numbers 1 through 6, inclusive, has an equal probability of being the outcome of a roll of a single, fair die. Thus, in this embodiment, each of the six different selectable roulette wheels has an equal probability of being selected for a play of the roulette game (i.e., each of the numbers associated with the roulette wheels has an equal probability of being the outcome of a roll of a single, fair die).

In various embodiments, there is non-uniform probability of any specific one of the different selectable roulette wheels being selected. In other words, in these embodiments one or more of the different selectable roulette wheels is more likely to be selected than one or more of the other different selectable roulette wheels. For example, one of these embodiments includes five different selectable roulette wheels: a standard American roulette wheel, a roulette wheel having all red wells over-represented (i.e., two of each red well), a roulette wheels having all black wells over-represented (i.e., two of each black well), a roulette wheel having all even-numbered wells over-represented (i.e., two of each even-numbered well, excluding wells numbered 0 and 00), and a roulette wheel having all odd-numbered wells over-represented (i.e., two of each odd-numbered well). In this example embodiment the roll of a single, fair, ten-sided die would select the standard wheel 60% of the time and one of the over-represented wheels (i.e., non-standard wheels) 40% of the time in the following manner: a die value of 1 selects the wheel with all red wells over-represented; a die value of 2 selects the wheel with all black wells over-represented; a die value of 3 selects the wheel with all even-numbered wells over-represented; a die value of 4 selects the wheel with all odd-numbered wells over-represented; and die values between 5 and 10, inclusive, selects the standard wheel.

The present disclosure thus contemplates that, in various embodiments, for each play the roulette game, each of the different selectable roulette wheels has a same probability of being selected. However, it should be appreciated that in other embodiments one or more of the different selectable roulette wheels have a greater probability of being selected than one or more of the other roulette wheels in one or more plays of the roulette game.

It should be appreciated that the present disclosure contemplates that any suitable quantity of different selectable roulette wheels may be utilized for a play of a roulette game. In one embodiment, the different selectable roulette wheel employed in a play of the roulette game is selected from the same quantity of different selectable roulette wheels for each play of the roulette game. In other embodiments, the different selectable roulette wheel employed in a play of the roulette game is selected from a different quantity of different selectable roulette wheels for one, a plurality, or each play of the roulette game.

In various embodiments of the present disclosure, the different selectable roulette wheels that are selectable for a play of the roulette game are grouped such that the average expected payback percentage for the roulette game (when calculated based on a suitable quantity of plays of the roulette game) is the same as a standard roulette game employing one roulette wheel (e.g., a roulette game employing a standard European or American roulette wheel). For example, if the set of different selectable roulette wheels has one standard roulette wheel (such as a standard European roulette wheel), one roulette wheel with a twenty-five percent higher chance of indicating a black number outcome, and one roulette wheel with an twenty-five percent higher chance of indicating a red number outcome, and there is an equal chance of selecting each of these different selectable roulette wheels for each play of the roulette game, the average expected payback percentage to the player or players will be the same regardless of the player's or players' wagers. Of course, for each actual play, the actual payout may or may not be in accordance with the average expected payback percentage.

In certain embodiments, a non-uniform probability of different selectable roulette wheel selection is employed to normalize the long-term expected return to player for all roulette wagers that are the same as those in a standard roulette game. This normalization is described below with respect to an example embodiment including four different selectable roulette wheels: one standard European roulette wheel, a wheel with twice as many numbered red wells as the standard European roulette wheel (i.e., including 36 numbered red wells including two red wells of each number rather than 18 numbered red wells), a wheel with twice as many black wells as the standard European roulette wheel (i.e., including 36 numbered black wells including two black wells of each number rather than 18 numbered black wells); and a wheel with twice as many green wells as the standard European roulette wheel (i.e., including 2 numbered green wells rather than 1 numbered green well). Table 1 below includes the compositions of each of the four different selectable roulette wheels in this example embodiment, and Table 2 below includes the probability of winning the listed wager type when one of the listed different selectable roulette wheels is selected. It should be appreciated that the probabilities of being selected of any suitable set of roulette wheels may be determined in this manner. For example, Table 3 below includes the compositions of each of four different selectable roulette wheels in a similar embodiment based on an American roulette wheel rather than a European roulette wheel, and Table 4 below includes the corresponding probability table.

TABLE 1

European Roulette-Based Example: Different Selectable Roulette Wheel Types

| | DIFFERENT SELECTABLE ROULETTE WHEEL TYPE | | | |
|---|---|---|---|---|
| Wheel Composition | Standard Wheel | Double Red | Double Black | Double Green |
| Numbered Red Wells | 18 | 36 | 18 | 18 |
| Numbered Black Wells | 18 | 18 | 36 | 18 |
| Numbered Green Wells | 1 | 1 | 1 | 2 |
| Total Numbered Wells | 37 | 55 | 55 | 38 |

TABLE 2

European Roulette-Based Example: Probability of Winning Listed Wager Type When Listed Different Selectable Roulette Wheel Is Selected

| | DIFFERENT SELECTABLE ROULETTE WHEEL TYPE | | | |
|---|---|---|---|---|
| WAGER TYPE | Standard Wheel | Double Red | Double Black | Double Green |
| Color Wager on Red | 18/37 | 36/55 | 18/55 | 18/38 |
| Color Wager on Black | 18/37 | 18/55 | 36/55 | 18/38 |
| Number Wager on Numbered Red Well | 1/37 | 1/55 | 1/55 | 1/38 |
| Number Wager on Numbered Black Well | 1/37 | 1/55 | 2/55 | 1/38 |
| Number Wager on 0 | 1/37 | 1/55 | 1/55 | 2/38 |

TABLE 3

American Roulette-Based Example Different Selectable Roulette Wheel Types

| | DIFFERENT SELECTABLE ROULETTE WHEEL TYPE | | | |
|---|---|---|---|---|
| Wheel Composition | Standard Wheel | Double Red | Double Black | Double Green |
| Numbered Red Wells | 18 | 36 | 18 | 18 |
| Numbered Black Wells | 18 | 18 | 36 | 18 |
| Numbered Green Wells | 2 | 2 | 2 | 4 |
| Total Numbered Wells | 38 | 56 | 56 | 40 |

TABLE 4

American Roulette-Based Example: Probability of Winning Listed Wager Type When Listed Different Selectable Roulette Wheel Is Selected

| | DIFFERENT SELECTABLE ROULETTE WHEEL TYPE | | | |
|---|---|---|---|---|
| WAGER TYPE | Standard Wheel | Double Red | Double Black | Double Green |
| Color Wager on Red | 18/38 | 36/56 | 18/56 | 18/40 |
| Color Wager on Black | 18/38 | 18/56 | 36/56 | 18/40 |

TABLE 4-continued

American Roulette-Based Example: Probability of Winning Listed Wager Type When Listed Different Selectable Roulette Wheel Is Selected

| | DIFFERENT SELECTABLE ROULETTE WHEEL TYPE | | | |
|---|---|---|---|---|
| WAGER TYPE | Standard Wheel | Double Red | Double Black | Double Green |
| Number Wager on Numbered Red Well | 1/38 | 2/56 | 1/56 | 1/40 |
| Number Wager on Numbered Black Well | 1/38 | 1/56 | 2/56 | 1/40 |
| Number Wager on 0 | 1/38 | 1/56 | 1/56 | 2/40 |

In this example, the probability of each of the different selectable roulette wheels being selected is established such that the chance of any specific outcome across the set of non-standard different selectable roulette wheels (i.e., the double red, double black, and double green wheels in this example embodiment) is the same as the chance of that specific outcome occurring on the standard European roulette wheel.

In certain embodiments, the gaming system makes a single determination as to which of the different selectable roulette wheels will be used for a play of the roulette game. In these embodiments, each of the different selectable roulette wheels is associated with a probability of being selected, and the gaming system uses those probabilities to determine which of the different selectable roulette wheels to select. In other embodiments, the gaming system first determines whether to select a standard or a non-standard wheel and, if the gaming system determines to select a non-standard wheel, then determines which non-standard wheel to use in the play of the roulette game.

In various embodiments, the relative wheel selection probabilities required to normalize outcome odds and long-term expected return to player given a set of three non-standard different selectable roulette wheels including a double red WHEEL R, a double black WHEEL B, and a double green WHEEL G are calculated by solving the following set of equations:

$$P(\text{selecting WHEEL } G) = \frac{P(\text{green}\mid\text{standard wheel}) - P(\text{green}\mid\text{WHEEL } R)}{P(\text{green}\mid\text{WHEEL } G) - P(\text{green}\mid\text{WHEEL } R)} \tag{1}$$

$$P(\text{selecting WHEEL } R) = P(\text{selecting WHEEL } B) = 1 - \frac{P(\text{selecting WHEEL } G)}{2} \tag{2}$$

Equation (1) is derived by solving the following equality:

$$P(\text{green}|\text{standard wheel})=(P(\text{selecting WHEEL } G))(P(\text{green}|\text{WHEEL } G))+(1-(P(\text{selecting WHEEL } G))(P(\text{green}|!\text{WHEEL } G))) \tag{3}$$

Thus, in this example embodiment, (1) the chance of any specific outcome across the three non-standard wheels, and (2) the long-term expected return to player across the three non-standard wheels would match (1) the chance of any specific outcome on a standard European roulette wheel, and (2) the long-term expected return to player for a standard European roulette wheel, respectively, when these non-standard different selectable roulette wheels are selected in the following proportions relative to one another: 55/148 chance of selecting the double red different selectable roulette wheel, 55/148 chance of selecting the double black different selectable roulette wheel, and 38/148 chance of selecting the double green different selectable roulette wheel.

Similarly, for the game based on standard American Roulette shown in Tables 3 and 4, (1) the chance of any specific outcome across the three non-standard wheels, and (2) the long-term expected return to player across the three non-standard wheels would match (1) the chance of any specific outcome on a standard American roulette wheel, and (2) the long-term expected return to player for a standard American roulette wheel, respectively, when these non-standard different selectable roulette wheels are selected in the following proportions relative to one another: 7/19 chance of selecting the double red different selectable roulette wheel, 7/19 chance of selecting the double black different selectable roulette wheel, and 5/19 chance of selecting the double green different selectable roulette wheel.

The present disclosure contemplates that the different selectable roulette wheels may be different in any one of a variety of different manners. In various example embodiments, one or more of the different selectable roulette wheels will, in comparison to a standard roulette wheel such as an American or European roulette wheel:

(1) include one or more additional numbered red wells,
(2) include one or more additional unnumbered red wells,
(3) include one or more additional numbered black wells,
(4) include one or more additional unnumbered black wells,
(5) include one or more additional wells numbered with high numbers (such as numbers greater than or equal to 19),
(6) include one or more additional wells numbered with low numbers (such as numbers less than 19),
(7) include one or more additional wells numbered with lower third numbers (such as numbers between 1 and 12, inclusive),
(8) include one or more additional wells numbered with intermediate third numbers (such as numbers between 13 and 24, inclusive),
(9) include one or more additional wells numbered with higher third numbers (such as numbers between 25 and 36, inclusive),
(10) include one or more additional wells numbered with odd numbers,
(11) include one or more additional wells numbered with even numbers,
(12) include one or more additional wells numbered with a number included in a first column wager (such as numbers 1, 4, 7, 10, 13, 16, 19, 22, 25, 28, 31, and 34),
(13) include one or more additional wells numbered with a number included in a second column wager (such as numbers 2, 5, 8, 11, 14, 17, 20, 23, 26, 29, 32, and 35),
(14) include one or more additional wells numbered with a number included in a third column wager (such as numbers 3, 6, 9, 12, 15, 18, 21, 24, 27, 30, 33, and 36),
(15) include one or more numbered red wells of a larger or smaller size,
(16) include one or more unnumbered red wells of a larger or smaller size,
(17) include one or more numbered black wells of a larger or smaller size,
(18) include one or more unnumbered black wells of a larger or smaller size,
(19) include one or more wells of a larger or smaller size numbered with high numbers (such as additional numbers greater than or equal to 19),
(20) include one or more wells of a larger or smaller size numbered with low numbers (such as numbers less than 19),
(21) include one or more wells of a larger or smaller size numbered with intermediate numbers (such as numbers between 10 and 25),
(22) include one or more odd numbered wells of a larger or smaller size,
(23) include one or more even numbered wells of a larger or smaller size,
(24) have one or more non-red wells replaced by one or more red wells,
(25) have one or more non-black wells replaced by one or more black wells,
(26) have one or more wells numbered with high numbers replaced by one or more wells numbered with low numbers wells,
(27) have one or more wells numbered with low numbers replaced by one or more wells numbered with high numbers,
(28) have one or more additional alternative function wells (as described below),
(29) have one or more wells replaced by one or more alternative function wells (as described below), and/or
(30) any suitable combination of the above.

In various other, more specific examples in which a set of different selectable roulette wheels includes one or more different selectable roulette wheels having additional wells:

(1) one or more of the different selectable roulette wheels include k number of each standard red well, where k is greater than 1;
(2) one or more of the different selectable roulette wheels include k number of each standard black well, where k is greater than 1;
(3) one or more of the different selectable roulette wheels include k number of each standard well numbered 19 through 36, inclusive, where k is greater than 1;
(4) one or more of the different selectable roulette wheels include k number of each standard well numbered 1 through 18, inclusive, where k is greater than 1;
(5) one or more of the different selectable roulette wheels include k number of each standard well numbered with an even number (excluding any green 0 well or green 00 well), where k is greater than 1;
(6) one or more of the different selectable roulette wheels include k number of each standard well numbered with an odd number, where k is greater than 1;
(7) one or more of the different selectable roulette wheels include k number of each well numbered with a number that produces a remainder of 1 when divided by 3, where k is greater than 1;
(8) one or more of the different selectable roulette wheels include k number of each well numbered with a number that produces a remainder of 2 when divided by 3, where k is greater than 1;
(9) one or more of the different selectable roulette wheels include k number of each well numbered with a number greater than 0 that produces a remainder of 0 when divided by 3, where k is greater than 1;
(10) one or more of the different selectable roulette wheels include k number of each standard well numbered 1 through 12, inclusive, where k is greater than 1;
(11) one or more of the different selectable roulette wheels include k number of each standard well numbered 13 through 24, inclusive, where k is greater than 1;

(12) one or more of the different selectable roulette wheels include k number of each standard well numbered 25 through 36, inclusive, where k is greater than 1; and/or

(13) one or more of the different selectable roulette wheels include k number of each standard green well, where k is greater than 1.

In various other, more specific examples in which a set of different selectable roulette wheels includes one or more different selectable roulette wheels having one or more wells of a different size than other wells:

(1) every red well of one or more of the different selectable roulette wheels is wider than every non-red well;

(2) every black well of one or more of the different selectable roulette wheels is wider than every non-black well;

(3) every high-numbered well (i.e., wells numbered 19 through 36, inclusive) of one or more of the different selectable roulette wheels is wider than every non-high-numbered well;

(4) every low-numbered well (i.e., wells numbered 1 through 18, inclusive) of one or more of the different selectable roulette wheels is wider than every non-low-numbered well;

(5) every even-numbered well (i.e., every even-numbered well among the wells numbered 2 through 36, inclusive) of one or more of the different selectable roulette wheels is wider than every non-even-numbered well;

(6) every odd-numbered well (i.e., every odd-numbered well among the wells numbered 1 through 35, inclusive) of one or more of the different selectable roulette wheels is wider than every non-odd-numbered well;

(7) each well of one or more of the different selectable roulette wheels numbered with a number of that produces a remainder of 1 when divided by 3 is wider than every other well;

(8) each well of one or more of the different selectable roulette wheels numbered with a number produces a remainder of 2 when divided by 3 is wider than every other well;

(9) each well of one or more of the different selectable roulette wheels numbered with a number greater than 0 that produces a remainder of 0 when divided by 3 is wider than every other well;

(10) every well of one or more of the different selectable roulette wheels numbered 1 through 12, inclusive, is wider than every other well;

(11) every well of one or more of the different selectable roulette wheels numbered 13 through 24, inclusive, is wider than every other well;

(12) every well of one or more of the different selectable roulette wheels numbered 25 through 36, inclusive, is wider than every other well; and/or

(13) every green well of one or more of the different selectable roulette wheels is wider than every non-green well;

In various other, more specific examples, for a set of different selectable roulette wheels:

(1) one or more of the different selectable roulette wheels include k number of each standard even-numbered red well, where k is greater than 1;

(2) one or more of the different selectable roulette wheels include k number of each standard odd-numbered red well, where k is greater than 1;

(3) one or more of the different selectable roulette wheels include k number of each standard even-numbered black well, where k is greater than 1;

(4) one or more of the different selectable roulette wheels include k number of each standard odd-numbered black well, where k is greater than 1;

(5) one or more of the different selectable roulette wheels include k number of each standard high-numbered red well, where k is greater than 1;

(6) one or more of the different selectable roulette wheels include k number of each standard low-numbered red well, where k is greater than 1;

(7) one or more of the different selectable roulette wheels include k number of each standard high-numbered black well, where k is greater than 1;

(8) one or more of the different selectable roulette wheels include k number of each standard low-numbered black well, where k is greater than 1;

(9) one or more of the different selectable roulette wheels include k number of each standard well numbered with an even number between 20 and 36, inclusive, where k is greater than 1;

(10) one or more of the different selectable roulette wheels include k number of each standard well numbered with an odd number between 19 and 35, inclusive, where k is greater than 1;

(11) one or more of the different selectable roulette wheels include k number of each standard well numbered with an even number between 2 and 18, inclusive, where k is greater than 1;

(12) one or more of the different selectable roulette wheels include k number of each standard well numbered with an odd number between 1 and 17, inclusive, where k is greater than 1;

(13) one or more of the different selectable roulette wheels include k number of each standard red well numbered with an even number between 20 and 36, inclusive, where k is greater than 1;

(14) one or more of the different selectable roulette wheels include k number of each standard black well numbered with an even number between 20 and 36, inclusive, where k is greater than 1;

(15) one or more of the different selectable roulette wheels include k number of each standard red well numbered with an odd number between 19 and 35, inclusive, where k is greater than 1;

(16) one or more of the different selectable roulette wheels include k number of each standard black well numbered with an odd number between 19 and 35, inclusive, where k is greater than 1;

(17) one or more of the different selectable roulette wheels include k number of each standard red well numbered with an even number between 2 and 18, inclusive, where k is greater than 1;

(18) one or more of the different selectable roulette wheels include k number of each standard black well numbered with an even number between 2 and 18, inclusive, where k is greater than 1;

(19) one or more of the different selectable roulette wheels include k number of each standard red well numbered with an odd number between 1 and 17, inclusive, where k is greater than 1; and/or

(20) one or more of the different selectable roulette wheels include k number of each standard black well numbered with an odd number between 1 and 17, inclusive, where k is greater than 1.

In various other, more specific examples including a set of different selectable roulette wheels:

(1) every even-numbered red well of one or more of the different selectable roulette wheels is wider than every other well;

(2) every odd-numbered red well of one or more of the different selectable roulette wheels is wider than every other well;

(3) every even-numbered black well of one or more of the different selectable roulette wheels is wider than every well;

(4) every odd-numbered black well of one or more of the different selectable roulette wheels is wider than every well;

(5) every high-numbered red well of one or more of the different selectable roulette wheels is wider than every other well;

(6) every high-numbered black well of one or more of the different selectable roulette wheels is wider than every other well;

(7) every low-numbered red well of one or more of the different selectable roulette wheels is wider than every other well;

(8) every low-numbered black well of one or more of the different selectable roulette wheels is wider than every other well;

(9) every even-numbered well of one or more of the different selectable roulette wheels is wider than every other well;

(10) every even-numbered well numbered 20 through 36, inclusive, of one or more of the different selectable roulette wheels is wider than every other well;

(11) every odd-numbered well numbered 1 through 17, inclusive, of one or more of the different selectable roulette wheels is wider than every other well;

(12) every odd-numbered well numbered 19 through 35, inclusive, of one or more of the different selectable roulette wheels is wider than every other well;

(13) every even-numbered red well numbered 2 through 18, inclusive, of one or more of the different selectable roulette wheels is wider than every other well;

(14) every even-numbered black well numbered 2 through 18, inclusive, of one or more of the different selectable roulette wheels is wider than every other well;

(15) every even-numbered red well numbered 20 through 36, inclusive, of one or more of the different selectable roulette wheels is wider than every other well;

(16) every even-numbered black well numbered 20 through 36, inclusive, of one or more of the different selectable roulette wheels is wider than every other well;

(17) every odd-numbered red well numbered 1 through 17, inclusive, of one or more of the different selectable roulette wheels is wider than every other well;

(18) every odd-numbered black well numbered 1 through 17, inclusive, of one or more of the different selectable roulette wheels is wider than every other well;

(19) every odd-numbered red well numbered 19 through 35, inclusive, of one or more of the different selectable roulette wheels is wider than every other well; and/or

(20) every odd-numbered black well numbered 19 through 35, inclusive, of one or more of the different selectable roulette wheels is wider than every other well.

It should be appreciated that the present disclosure contemplates that to form or configure a different selectable roulette wheel (as compared to a standard roulette wheel, such as a standard European roulette wheel): (1) the total quantity of wells remains the same, but one or more of the wells are changed (as compared to the standard roulette wheel); (2) the total quantity of wells changes by adding or subtracting one or more wells (as compared to a standard roulette wheel); or (3) the total quantity of wells changes by adding or subtracting one or more wells and one or more of the wells are changed (as compared to a standard roulette wheel).

In the embodiments where the total quantity of wells remains the same and one or more of the wells are changed, the change of one or more wells comes at the expense of one or more of the other wells. For example, if a red well numbered 32 on a standard European roulette wheel (which has 37 numbered and colored wells including 18 red wells, 18 black wells, and 1 green well) is replaced by a black well numbered 35 to form one of the different selectable roulette wheels of the set of different selectable roulette wheels, the probabilities of achieving certain of the outcomes (i.e., the probabilities of the ball landing in certain of the wells), and thus the probabilities of the player winning on several of the different possible roulette game wagers, change when that different selectable roulette wheel is selected for the play of the roulette game. More specifically, in this example, when this different selectable roulette wheel is selected, the probability of the player winning on: (a) a red wager decreases (because the quantity of outcomes associated with the color red decreases from 18 to 17); (b) a black wager increases (because the quantity of outcomes associated with the color black increases from 18 to 19); (c) an even wager decreases (because the quantity of outcomes associated with an even number between 1 and 36, inclusive, decreases from 18 to 17); (d) an odd wager increases (because the quantity of outcomes associated with an odd number between 1 and 36, inclusive, increases from 18 to 19); (e) a number 32 wager decreases to zero (because the outcome associated with the number 32 is completely removed from this different selectable roulette wheel); (f) a number 35 wager increases (because the roulette wheel now has two outcomes instead of one associated with the number 35); and (g) a number 0 wager remains the same (because the number of outcomes associated with the number 0 remains the same). It should be appreciated that the probability of the player winning on other suitable wagers may also change.

It should be appreciated that, in this embodiment, replacing or eliminating one or more wells with another well may eliminate any chance for a player to win on a specific wager placed on an outcome exclusively associated with that well. For example, if the player places a wager on number 32, and the different selectable roulette wheel that does not include a well having number 32 is selected for that play of the roulette game, the player has no chance of winning on that wager. Thus, the first random determination of which of the different selectable roulette wheels to select for that play of the game may, in and of itself, resolve one of the player's wagers for that play of the roulette game. Certain players may not appreciate this loss of an opportunity to win (before the selected roulette wheel is spun) even though their opportunities to win on other wagers may be increased.

To compensate for this potential problem when such a different selectable roulette wheel is employed, in one example embodiment, one or more alternative function wells, such as one or more bonus wells, also replace one or more of the wells on the different selectable roulette wheel to provide at least one opportunity for the player to win regardless of the player's wager. In other embodiments, one or more alternative function wells are added to one or more of the different selectable roulette wheels without replacing any wells. More specifically, as noted above, the present disclosure contemplates that, in certain embodiments, one or more of the different selectable roulette wheels have one or more alternative function wells (that replace one or more wells or that are included as additional wells). The alternative function wells are associated with one or more bonus outcomes. These bonus outcome(s) associated with the alternative function wells may be any suitable bonus outcomes such as, but not limited to: (a) a bonus outcome that provides a predetermined static bonus award; (b) a bonus outcome that provides a progressive bonus award; (c) a bonus outcome that provides a bonus game that may result in a bonus award, where the bonus game includes one or more random determinations of one or more bonus awards; (d) a bonus outcome that provides a bonus game that may result in a bonus award, where the bonus game includes one or more player inputs for determining the bonus award; and (e) a spin again outcome that provides one or more re-spins or additional spins of the roulette wheel without requiring the player or players to place additional wagers.

In certain embodiments, if the ball lands in an colored, unnumbered well, only color wagers (e.g., wagers on red or black) are evaluated. In these example embodiments, any other type of wager, such as a number wager, is returned to the player. In various other embodiments, if the ball lands in an colored, unnumbered well, number wagers on numbers associated with wells having that color are eligible for an award.

The present disclosure further contemplates that one or more of the different selectable roulette wheels may be different through a direct increase in the probability of one or more existing outcomes and a reduction of the probability of one or more other existing outcomes. In one such embodiment, this is accomplished by widening the respective well of one or more of the wells of the standard roulette wheel and reducing the width of one or more of the other wells.

In the embodiments in which the total quantity of wells changes, such as by the addition of one or more wells, this change also comes at the expense of one or more of the other wells in a different manner.

In various example embodiments, when one or more wells are added to a standard roulette wheel to form or configure one of the different selectable roulette wheels, to make room on the roulette wheel for such additional wells the sizes of one or more of the other wells are changed. Particularly, the width of each of one or more of the other wells is changed. In one embodiment, the widths of all of the existing wells are changed to make room, and in other embodiments, the widths of less than all of the wells are changed.

In another example, one of the different selectable roulette wheels is formed or configured to double the probability of generating an outcome associated with the color red. More specifically, a standard American roulette wheel has 38 wells (including 18 red wells, 18 black wells, and 2 green wells), and the arc of each well is approximately 9.47 degrees or 0.165 radians (i.e., 360 degrees or $2\pi$ radians divided by 38 wells). In one example embodiment that doubles the probability of the red outcome, the different or changed roulette wheel has 56 wells (i.e., a double red well including 36 red wells, 18 black wells, and 2 green wells). In one example embodiment, this is accomplished by configuring this different roulette wheel with 56 individual wells each having a width of approximately 6.42 degrees or 0.112 radians. It should further be appreciated that the same probabilities may be alternatively accomplished by providing a different roulette wheel with 38 wells, some of which are of unequal width (such as 18 black wells and 2 green wells, each at approximately 6.42 degrees or 0.112 radians, and 18 red wells, each at approximately 12.84 degrees or 0.224 radians).

It should be appreciated that, in various embodiments including a physical roulette wheel, the doubling of the width of one or more of the wells with respect to each of the other wells may not exactly double the probability of the ball landing in a given double-wide well relative to one of the single-wide wells based on the physical nature of the gaming system, such as, but not limited to: the size and material of the ball; the size, shape, and material of the frets separating the wells; and the depth, shape, and material comprising the well. It should also be appreciated that, in certain embodiments including a virtual roulette wheel (such as in a video or computerized gaming system), the doubling of the width of one or more of the wells with respect to each of the other wells does exactly match the probability of occurrence with the proportions of well widths. In other words, in these embodiments, a double-wide well is exactly twice as likely to receive the ball than a single-wide well.

It should be appreciated that, in this example embodiment, changing the size of one or more wells (instead of replacing or eliminating one or more wells) changes the odds of one or more of the outcomes of the different selectable roulette wheel occurring (e.g., the ball landing in one of the wells) without totally eliminating any chance for a player to win on a specific wager exclusively associated with on one or more of the outcomes. In other words, since the player or players place one or more wagers, and then learn which of the different selectable roulette wheels will be employed in the play of the roulette game, the various embodiments of the present disclosure contemplate that the player or players may still have a chance, even if that chance is reduced, to win on each and every wager placed by the player or players because none of the wells are eliminated or replaced.

In certain embodiments, at least one of the set of different selectable roulette wheels is dynamically created based on a player's wager. In one of these embodiments, the dynamically created different selectable roulette wheels are created such that the player has a chance to win on each and every wager placed by the player, no matter which of the set of different selectable roulette wheels is selected for the play of the roulette game. For example, if a player places a wager on number 33, in this embodiment the gaming system dynamically creates one or more different selectable roulette wheels that each include the number 33 so that the player still has a chance to win (though that chance to win may be reduced or increased depending upon the created roulette wheel(s)) on that wager. In another of these embodiments, the dynamically created different selectable roulette wheels are created such that the player has an increased chance of winning on at least one of the player's wagers. For example, if a player places a wager on number 33, in this embodiment the gaming system dynamically creates one or more different selectable roulette wheels, at least one of which includes an additional well numbered 33 (or a well numbered 33 that is larger than the other wells). In another one of these embodiments, each of the dynamically created different selectable roulette wheels includes an additional well numbered 33 such that the player has an increased chance of winning associated with the player's wager regardless of which of the dynamically created different selectable roulette wheels is selected for the play of the roulette game. In another embodiment, the dynamically created different selectable roulette wheels are created such that the player has an increased chance of winning on one of the player's wagers and a decreased chance of winning on another one of the player's wagers. For example, if a player places a wager on number 33 and another wager on red, at least one of the dynamically created different selectable roulette wheels includes, for example, an additional black well numbered 33 (which provides the player with a higher probability of winning the number 33 wager and a lower probability of winning the red wager). In another embodiment, at least one of the dynamically created different selectable roulette wheels is created such that the player has an increased chance of winning one of the player's wagers and another one of the dynamically created different selectable roulette wheels is created such that the player has an decreased chance of winning another one of the player's wagers. It should be appreciated that different selectable roulette wheels may be dynamically created based on at least one wager from one or more players.

It should be appreciated from the above that each different roulette wheel may carry or support any suitable number of wells or landings.

It should further be appreciated that in certain alternative embodiments, one or more of the different selectable roulette wheels have colored wells without numbers and/or numbered wells without colors. In other words, the present disclosure contemplates configuring one or more of the different selectable roulette wheels with additional wells that are red without any number, black without any number, green without any number, or have a number and do not have any color. This enables the probabilities to be configured for each such different selectable roulette wheel in a different manner.

In certain embodiments of the present disclosure, all of the different selectable roulette wheels for a play of the roulette game have the same quantity of wells. In other embodiments of the present disclosure, two or more of the different selectable roulette wheels for a play of the roulette game have different quantities of wells.

As noted above, in certain embodiments of the present disclosure, the same set of different selectable roulette wheels is always available for each play of the roulette game. In other embodiments, only a subset of a plurality of different selectable roulette wheels is available for a particular play of the roulette game. In one such embodiment, the gaming system informs the player or players which of the different selectable roulette wheels are available for a particular play of the roulette game. In other such embodiments, the gaming system does not inform the player or players and the player or players do not know which of the different selectable roulette wheels will be available for a play of the roulette game. If player may see which of the different selectable roulette wheels will potentially be in play for a play of the roulette game, then the sum of all the outcomes of those different selectable roulette wheels is expected to be neutral. For example, if one of the different selectable roulette wheels favors red outcomes (e.g., has more red wells than black wells), then another one of the different selectable roulette wheels should favor black outcomes (e.g., should have more black wells than red wells).

In some embodiments, k wheels of n available different selectable roulette wheels are selected for a play of the roulette game, where k is greater than one and less than n. In these embodiments, each wager must be an integer multiple of k, and 1/kth of every wager is applied applies to each of the k wheels. For example, if k is equal to two, each wager must be a multiple of two, and one-half (i.e., 1/k) of each wager is applied to each of the two selected different selectable roulette wheels.

Referring now to the drawings, and particularly to FIG. 1, one example set of different selectable roulette wheels of one embodiment of the present disclosure is generally illustrated. In this example embodiment, the differences in the different selectable roulette wheels are accomplished by adding one or more additional wells to a standard European roulette wheel (described above). In this example, wells colored red are illustrated as having a white background, wells colored black are illustrated has having a black background, and wells colored green are illustrated as having a hatched background. More specifically, in this illustrated example embodiment: (a) first roulette wheel 30 (labeled wheel 1) includes wells having the same symbols or values as a standard European roulette wheel; (b) second roulette wheel 32 (labeled wheel 2) is the double red wheel described above, which includes two of each numbered red well; (c) third roulette wheel 34 (labeled wheel 3) is the double black wheel described above, which includes two of each numbered black well; and (d) fourth roulette wheel 36 (labeled wheel 4) is the double green wheel described above, which includes two of each numbered green well.

Thus, in this example embodiment, second, third, and fourth roulette wheels 32, 34, and 36 are each different than first roulette wheel 30 because they each include one or more additional wells. In this example embodiment, assuming, for each of the roulette wheels, that a ball has an equal chance or likelihood of landing in each of the wells of that roulette wheel, in comparison to first roulette wheel 30: (i) for second roulette wheel 32: there is a lower likelihood that the ball will land in a black well; there is a lower likelihood that the ball will land in a green well; there is a higher likelihood that the ball will land in a red well; there is a lower likelihood that the ball will land in the well numbered 0; there is a lower likelihood that the ball will land in one of the wells numbered 2, 4, 6, 8, 10, 11, 13, 15, 17, 20, 22, 24, 26, 28, 29, 31, 33, and 35; and there is a higher likelihood that the ball will land in one of the wells numbered 1, 3, 5, 7, 9, 12, 14, 16, 18, 21, 23, 25, 27, 30, 32, 34, and 36; (ii) for third roulette wheel 34: there is a higher likelihood that the ball will land in a black well; there is a lower likelihood that the ball will land in a green well; there is a lower likelihood that the ball will land in a red well; there is a lower likelihood that the ball will land in the well numbered 0; there is a higher likelihood that the ball will land in one of the wells numbered 2, 4, 6, 8, 10, 11, 13, 15, 17, 20, 22, 24, 26, 28, 29, 31, 33, and 35; and there is a lower likelihood that the ball will land in one of the wells numbered 1, 3, 5, 7, 9, 12, 14, 16, 18, 21, 23, 25, 27, 30, 32, 34, and 36; and (iii) for fourth roulette wheel 36: there is a lower likelihood that the ball will land in a black well; there is a higher likelihood that the ball will land in a green well; there is a lower likelihood that the ball will land in a red well; there is a higher likelihood that the ball will land in the well numbered 0; and there is a lower likelihood that the ball will land in one of the wells numbered 1 to 36, inclusive.

In this example embodiment, the roulette game includes a conventional betting station or wagering station (not shown), which is sometimes referred to as the betting layout. The wagering station enables the player or players to place wagers for each play of the roulette game. The wagering station is configured to indicate wagers placed with respect to individual symbols or a combination of symbols which may appear on the selected roulette wheel. In various embodiments, the wager's layout is the conventional wager layout.

In one embodiment, the wagering station includes a plurality of wagering regions that constitute a template specifying a grid of numbers and wagering options. The numbers in the grid correspond to the numbers and other wagering options on the roulette wheels. The player or players place their wager markers, such as at least one chip or token having a designated or desired denomination, on desired locations on the wagering station in a conventional manner. Each said location corresponds to one or more specific numbers and whose corresponding payout is based upon the quantity of numbers associated with that location. Each player may control the risk and potential award levels by selecting one or more of the wagering regions and a wager denomination, such as one dollar.

Figure 2A:
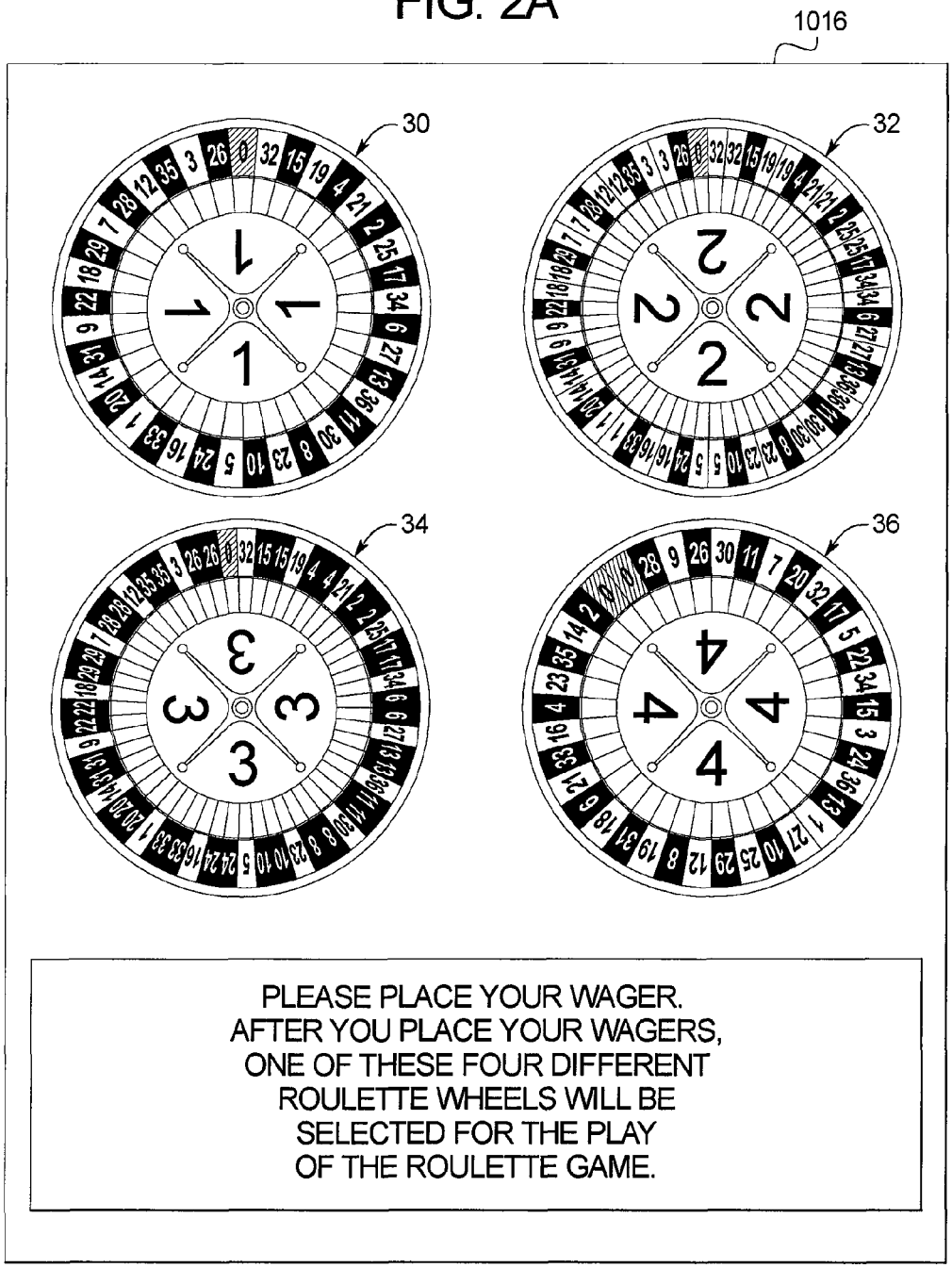
FIGS. 2A, 2B, 2C, and 2D are displays of a play of the roulette game using the different selectable roulette wheels of FIG. 1.

Referring now to FIGS. 2A, 2B, 2C, and 2D, one example game play using the set of different selectable roulette wheels of FIG. 1 displayed by display device 1016 of an electronic gaming device is illustrated. In this example, FIG. 2A illustrates that display device 1016 displays, and the player may see, all of roulette wheels 30, 32, 34, and 36 of the set of different selectable roulette wheels for the play of the roulette game. In certain other embodiments, the set of displayed different selectable roulette wheels may be a subset of a larger set of different selectable roulette wheels, such that different sets of the different selectable roulette wheels may be used for different plays of the roulette game. In this example, display device 1016 illustrated in FIG. 2A informs the player to place the player's wagers and that after the player places the player's wagers, one of the different selectable roulette wheels will be selected for that play of the roulette game. It should be appreciated that: (a) while the betting station is not shown, the display device may also display the betting station; and (b) any suitable betting station may be employed.

Figure 2B:
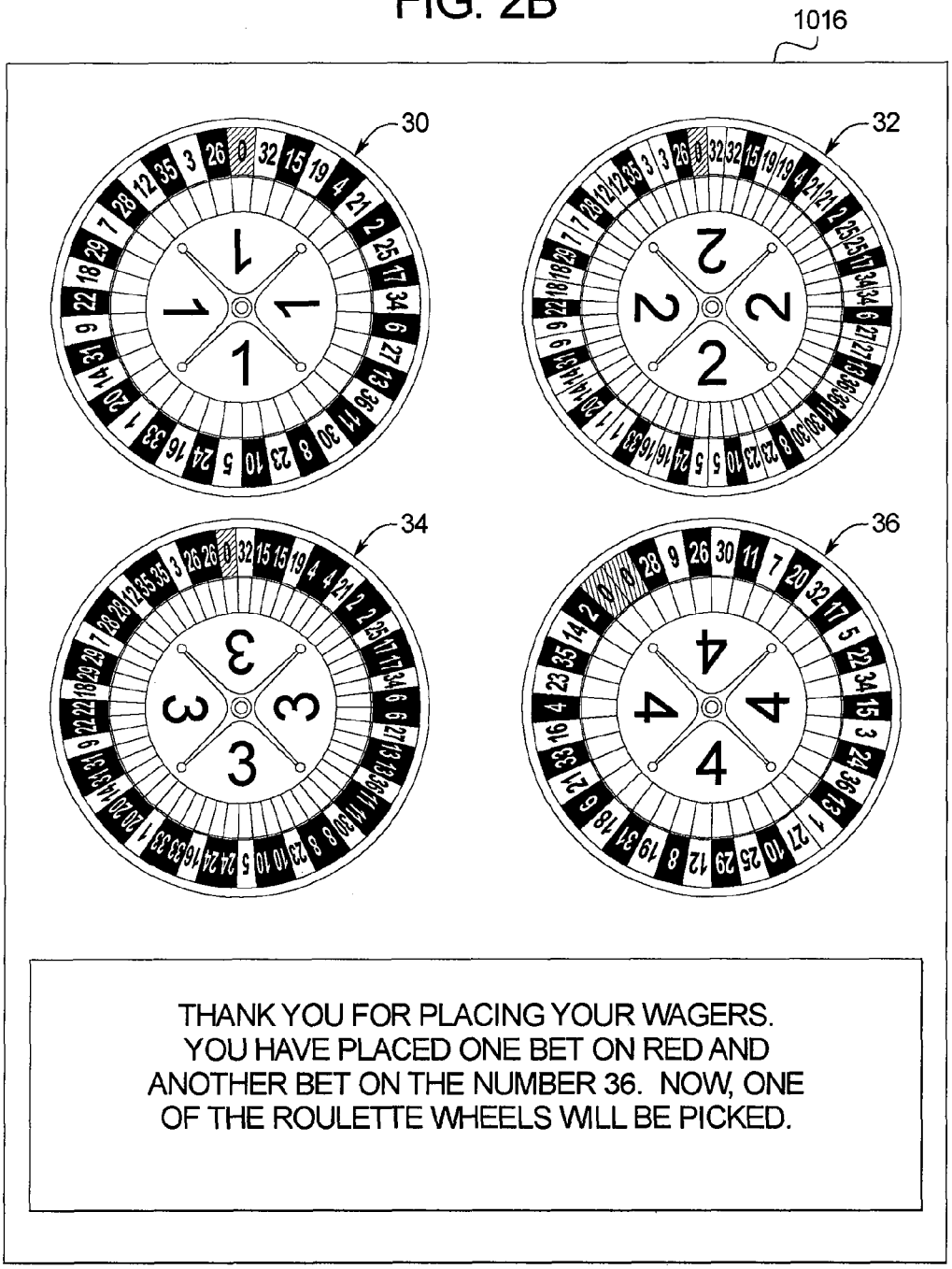

After the player places the player's wagers in this example, the display device 1016 illustrated in FIG. 2B acknowledges receipt of the player's wagers and informs the player that one of the different roulette wheels will be selected for that play of the roulette game. Specifically, in this illustrated example, the player has placed one wager on the color red and another wager on number 36. Thus, the player will win an award associated with the red wager if the outcome of the play of the roulette game is any of the red wells, and the player will win an award associated with the number 36 wager if the outcome of the play of the roulette game is any of the wells numbered 36. As mentioned above, it should be appreciated that: (a) the selection of the which of the different selectable roulettes wheel will be employed for that specific play of the roulette game may be determined in a variety of different manners; (b) the selection of the which of the different selectable roulette wheels will be employed for that specific play of the roulette game may be determined before or after the player places one or more wagers; and (c) the selection of the which of the different selectable roulette wheels will be employed for that specific play of the roulette game is determined independent, separate from, or without regard to the wagers placed by the player.

Figure 2C:
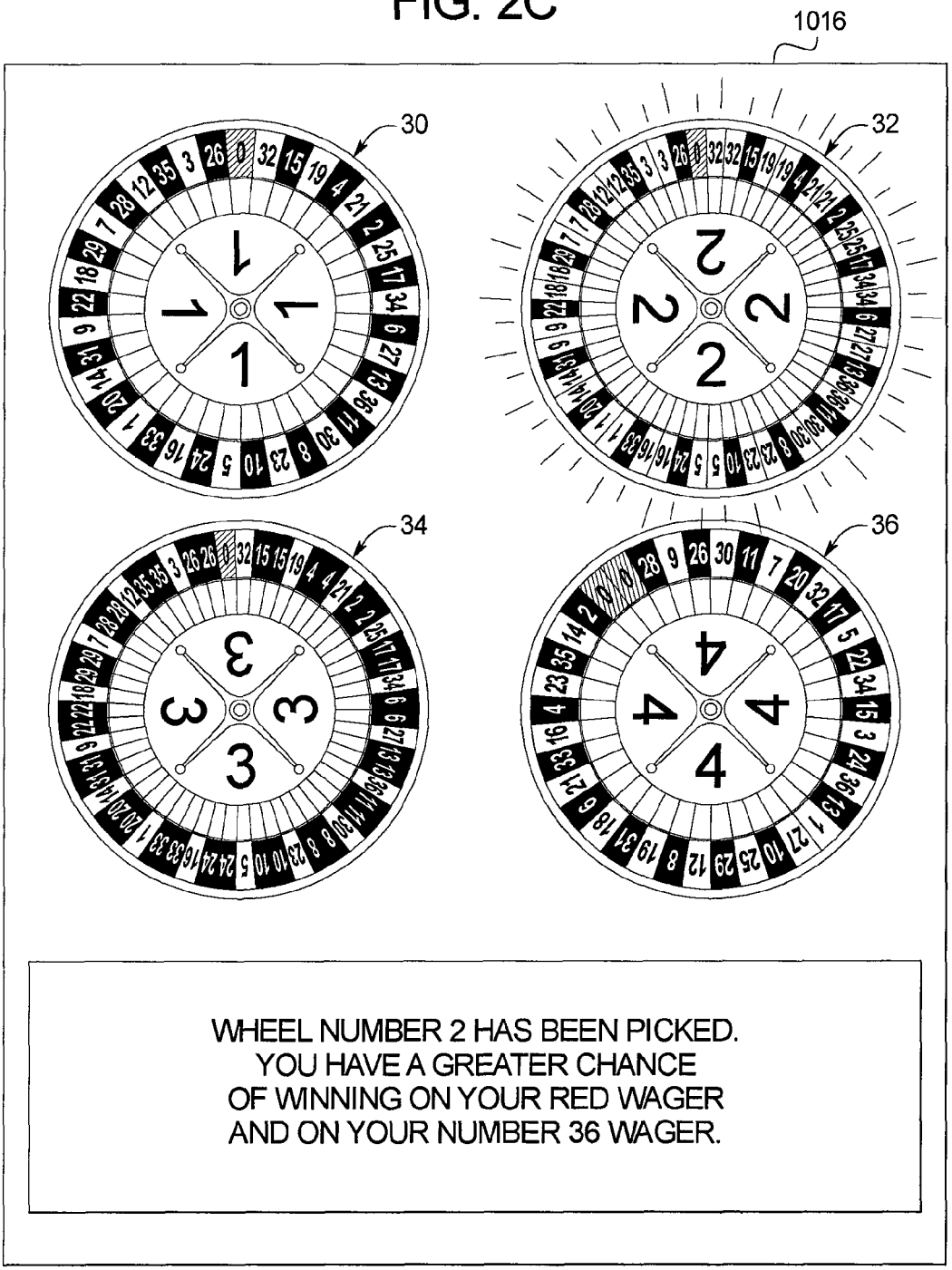
Figure 2D:
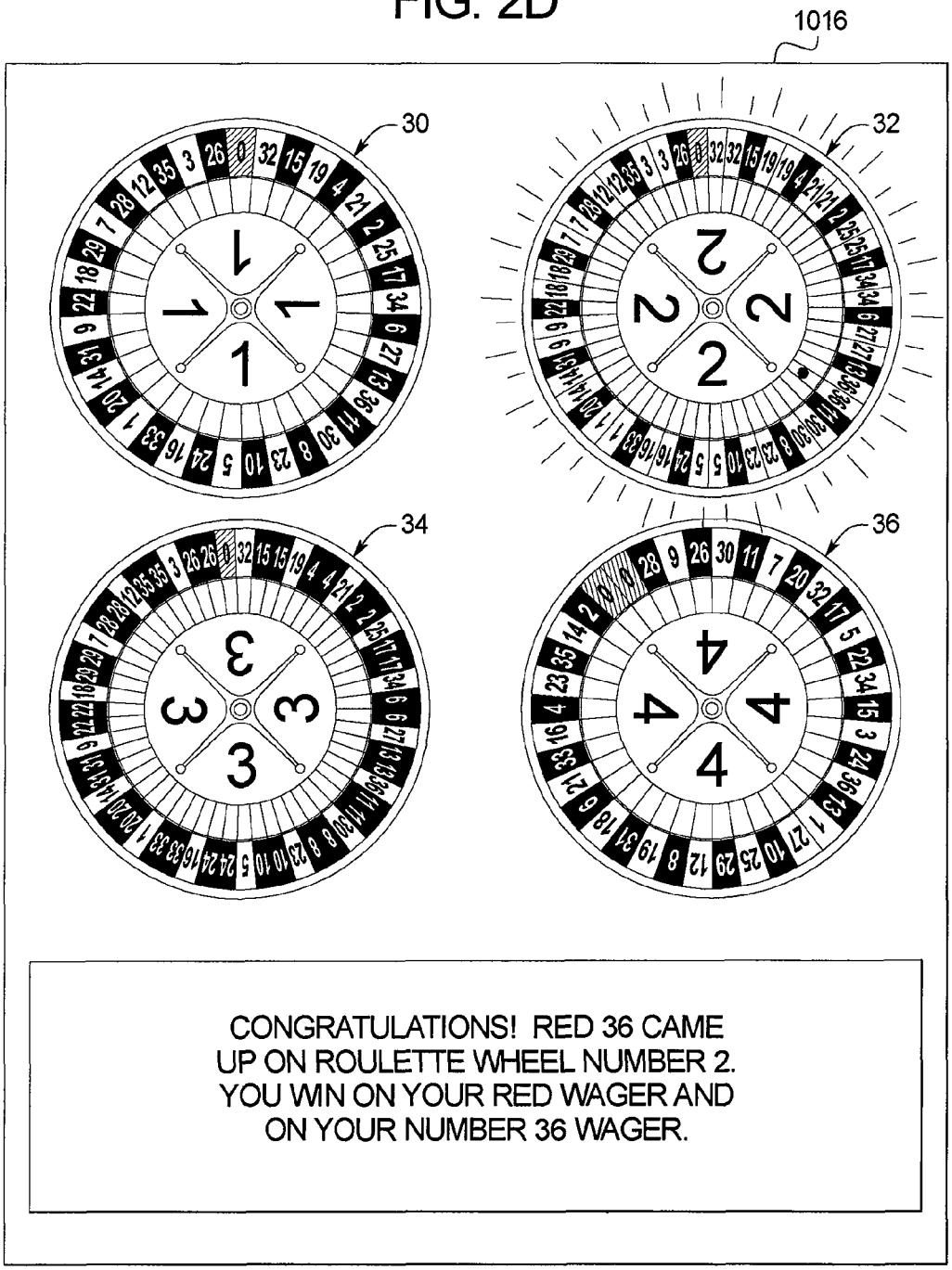

In this example, after the player places the player's wagers and after one of the different selectable roulette wheels is selected for the play of the roulette game, example, the display device 1016 illustrated in FIG. 2C informs the player which one of the different selectable roulette wheels is selected and will be used for that play of the roulette game. In this example, roulette wheel 32 (i.e., the double red wheel) is selected for that specific play of the roulette game. It should be appreciated that: (a) the selected roulette wheel may be indicated in any suitable manner; and (b) in video embodiments, the non-selected roulette wheels may be removed and the display of the selected roulette wheel will be employed for the play of the roulette game may be increased (e.g., by being increased in size).

After the player places the player's wagers and after one of the different selectable roulette wheels is selected for the play of the roulette game, one of the outcomes associated with the selected roulette wheel is determined (e.g., one of the wells of the selected roulette wheel is selected). After the outcome is determined, in this example play of the roulette game, display device 1016 illustrated in FIG. 2D informs the player which one of the outcomes was determined and on which wagers, if any, the player won. In this example, outcome 36 RED (i.e., the well colored red and numbered 36) of roulette wheel 32 was determined. As explained above, the player wins on both of the player's wagers. It should be appreciated that any suitable indication method or device for indicating the outcome and whether the player wins on the player's wagers may be employed.

Figure 3:
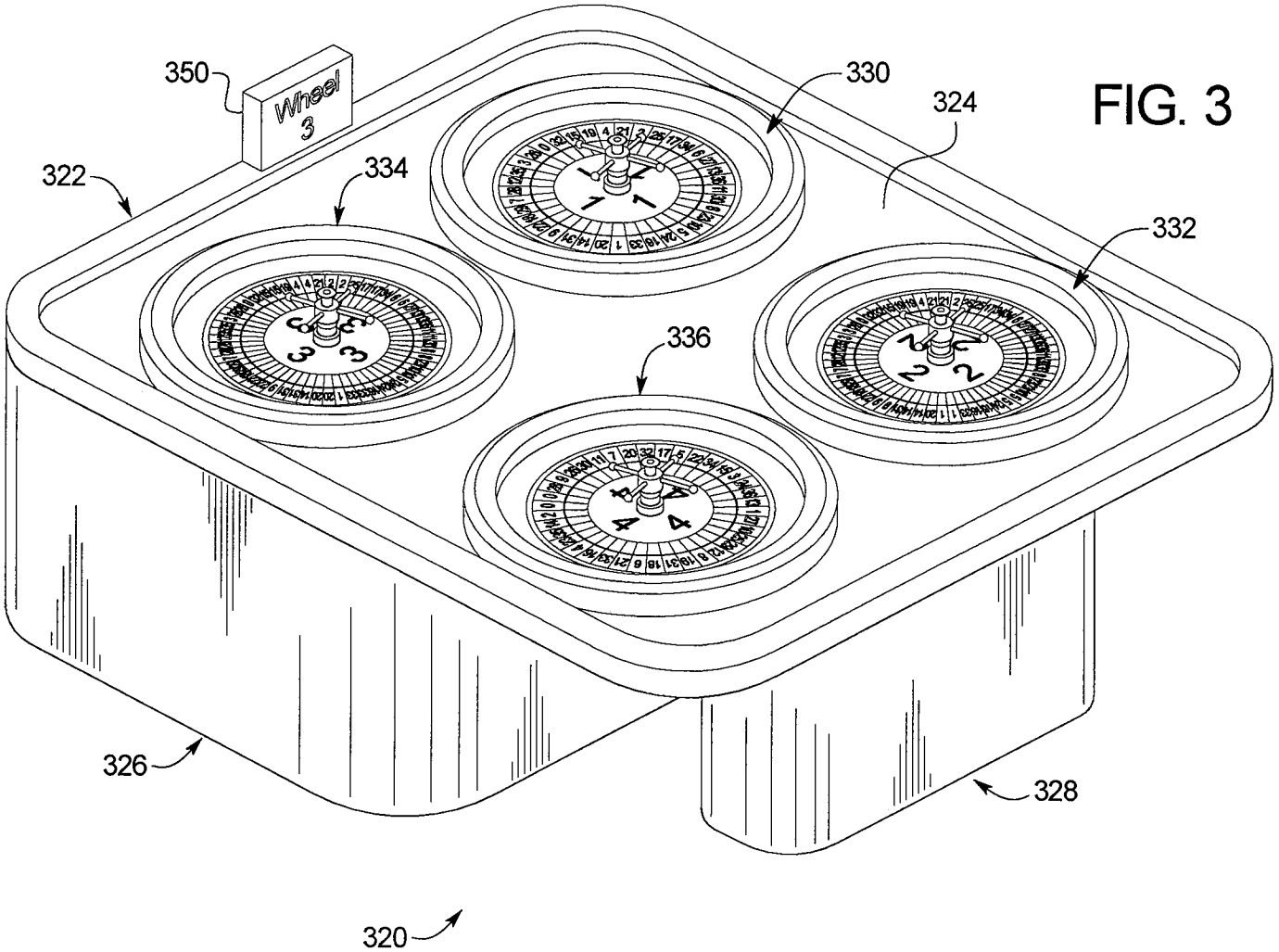
FIG. 3 is a perspective view of a physical roulette table of one example embodiment of the present disclosure configured to provide a roulette game with four different selectable roulette wheels.

Referring now FIG. 3, one example embodiment of the present disclosure that provides a multiple selectable roulette wheel gaming table 320 is generally illustrated. Multiple selectable roulette wheel gaming table 320 includes a support structure or table 322 having a playing surface or tabletop 324 supported by a plurality of legs 326 and 328. Multiple selectable roulette wheel gaming table 320 includes a plurality of different roulette wheel assemblies 330, 332, 334, and 336 supported by tabletop 324 and a multiplayer wagering station or area (not shown) that enables multiple players to simultaneously play or wager on the roulette game. It should be appreciated that the quantity of different selectable roulette wheels, the size of the different selectable roulette wheels, the arrangement of the different selectable roulette wheels, and the size and shape of the gaming table may vary in accordance with the present disclosure. In this illustrated embodiment, different selectable roulette wheels 330, 332, 334, and 336 are respectively labeled 1, 2, 3, and 4.

In this illustrated embodiment, each roulette wheel assembly includes: (a) a rotor assembly support or frame that supports a sloped wall or bowl; (b) a rod or spindle extending vertically upward from a center of the frame; (c) a bushing, set of bearings, or other friction reducer connected to the spindle; (d) a rotor coupled to the friction reducer and positioned concentrically within the substantially circular sloped wall; (e) a conical plate connected to the spindle to cover the inner portion of the rotor; (f) a housing that covers the frame; and (g) a plurality of wells or landings on the rotor positioned adjacent to the conical plate, each landing being sized to receive an indicator or object such as a ball. It should be appreciated that other suitable roulette wheel mechanical configurations may be employed in accordance with the present disclosure. It should be appreciated that the rotor may carry or support any suitable number of landings. As further described in detail below, although not readily seen in FIG. 3, each different selectable roulette wheel 330, 332, 334, and 336 has a different set of game symbols, and in this example a different set of numbers as further discussed above with respect to FIG. 1.

In this illustrated embodiment, multiple selectable roulette wheel gaming table 320 includes a roulette wheel indicator 350 that is configured to indicate the selected roulette wheel for each play of the roulette game. It should be appreciated that any suitable roulette wheel indicator may be employed in accordance with the present disclosure. It should also be appreciated that in this embodiment, a live dealer may simply indicate the selected roulette wheel by causing the rotor of that selected roulette wheel to spin and placing the ball in that selected roulette wheel. It should thus be appreciated that the roulette wheel indicator may be configured to be controlled by a dealer after the selection of one of the roulette wheels or controlled by a processor.

For each play of the roulette game at multiple selectable roulette wheel gaming table 320, the selection of one of the different selectable roulette wheels may be accomplished in any one of a variety of different suitable manners. This selection is preferably a random selection. In one embodiment, the selection is randomly done by a processor at or remote from multiple selectable roulette wheel gaming table 320 and indicated by roulette wheel indicator 350. In other embodiments, the dealer or one of the players may randomly select one of the different roulette wheels, such as by rolling a six sided die, or in another suitable manner. It should thus be appreciated that this random selection of which different roulette wheel will be used in the play of the roulette game adds an extra level of randomness to the play of the roulette game of the present disclosure.

Figure 4:
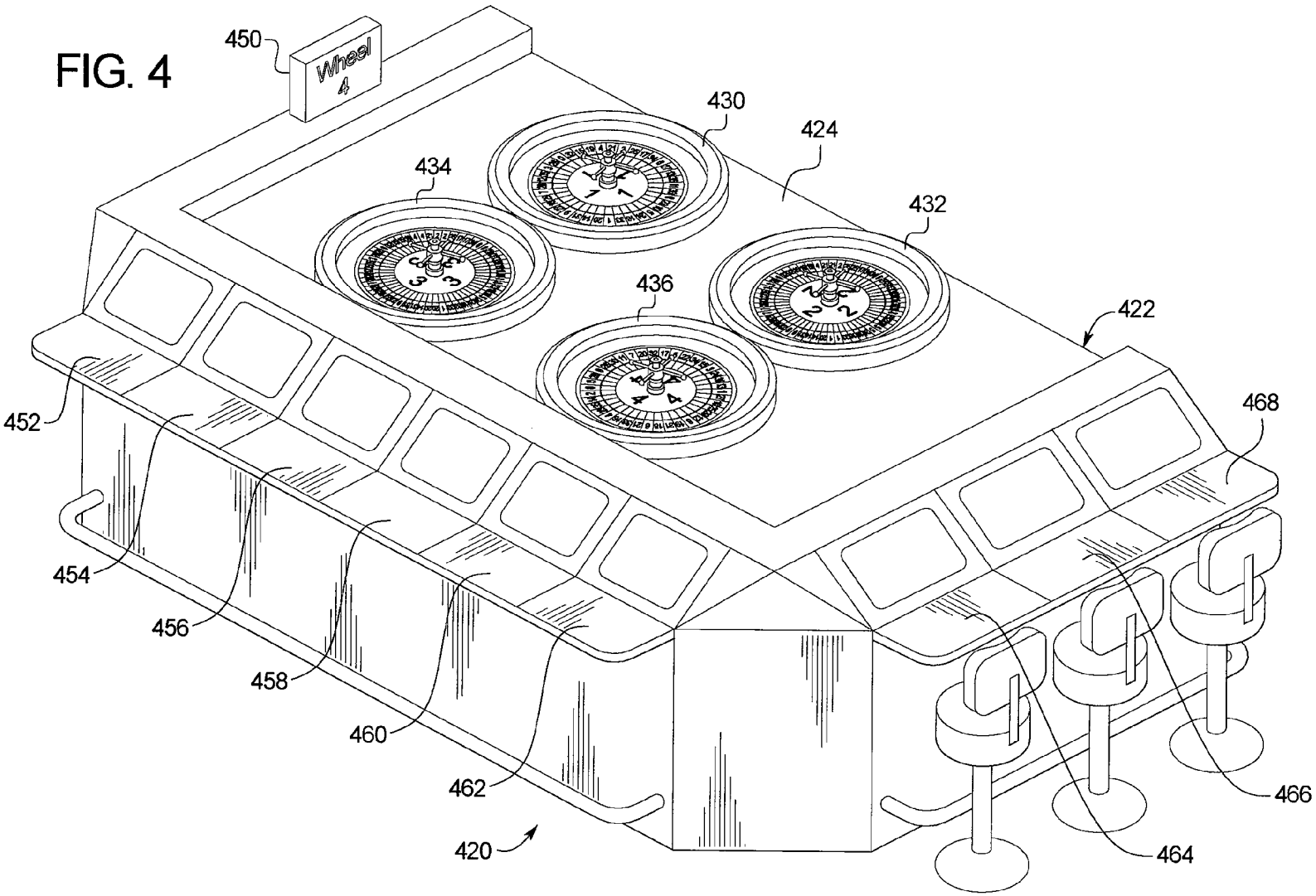
FIG. 4 is a perspective view of an electronic roulette table of another embodiment of the present disclosure configured to provide a roulette game with four different selectable roulette wheels.

Referring now to FIG. 4, another example embodiment of the present disclosure that provides a multiple selectable roulette wheel electronic gaming table 420 is generally illustrated. Multiple selectable roulette wheel electronic gaming table 420 includes a support structure or table 422 having a playing surface or tabletop 424 supported by a plurality of legs (not shown). Multiple selectable roulette wheel electronic gaming table 420 includes a plurality of different selectable roulette wheel assemblies 430, 432, 434, and 436 supported by tabletop 424 and a plurality of individual player wagering stations or areas 452, 454, 456, 458, 460, 462, 464, 466, and 468 that enable multiple players to simultaneously play or wager on the roulette game. It should be appreciated that the quantity of different selectable roulette wheels, the size of the different selectable roulette wheels, the arrangement of the different selectable roulette wheels, and the size and shape of the gaming table may vary in accordance with the present disclosure. In this illustrated embodiment, different selectable roulette wheels 430, 432, 434, and 436 are respectively labeled 1, 2, 3, and 4. In this illustrated embodiment, multiple selectable roulette wheel electronic gaming table 420 also includes a roulette wheel indicator 450 that is configured to indicate the selected roulette wheel for each play of the roulette game.

In one embodiment, the gaming table includes a selection mechanism configured to direct the ball into a random one of the different selectable roulette wheels. In this embodiment, a ball is inserted into the selection mechanism (e.g., placed into the selection mechanism by a dealer) after (or, in one embodiment, before or during) wagers are placed by the players. The selection mechanism is configured to route the ball into a random one of the different selectable roulette wheels. The roulette game is then played as described above. Thus, in this embodiment, rather than a dealer or processor randomly selecting one of the different selectable roulette wheels, the selection mechanism is configured to do so.

In another embodiment, the gaming system is fully-automatic. In this embodiment, the gaming system includes a processor that selects which of the different selectable roulette wheels to employ for a play of the roulette game, and then activates that selected different selectable roulette wheel and directs its corresponding ball launcher to launch a ball into that roulette wheel. The roulette game is then played as described above.

Figure 5:
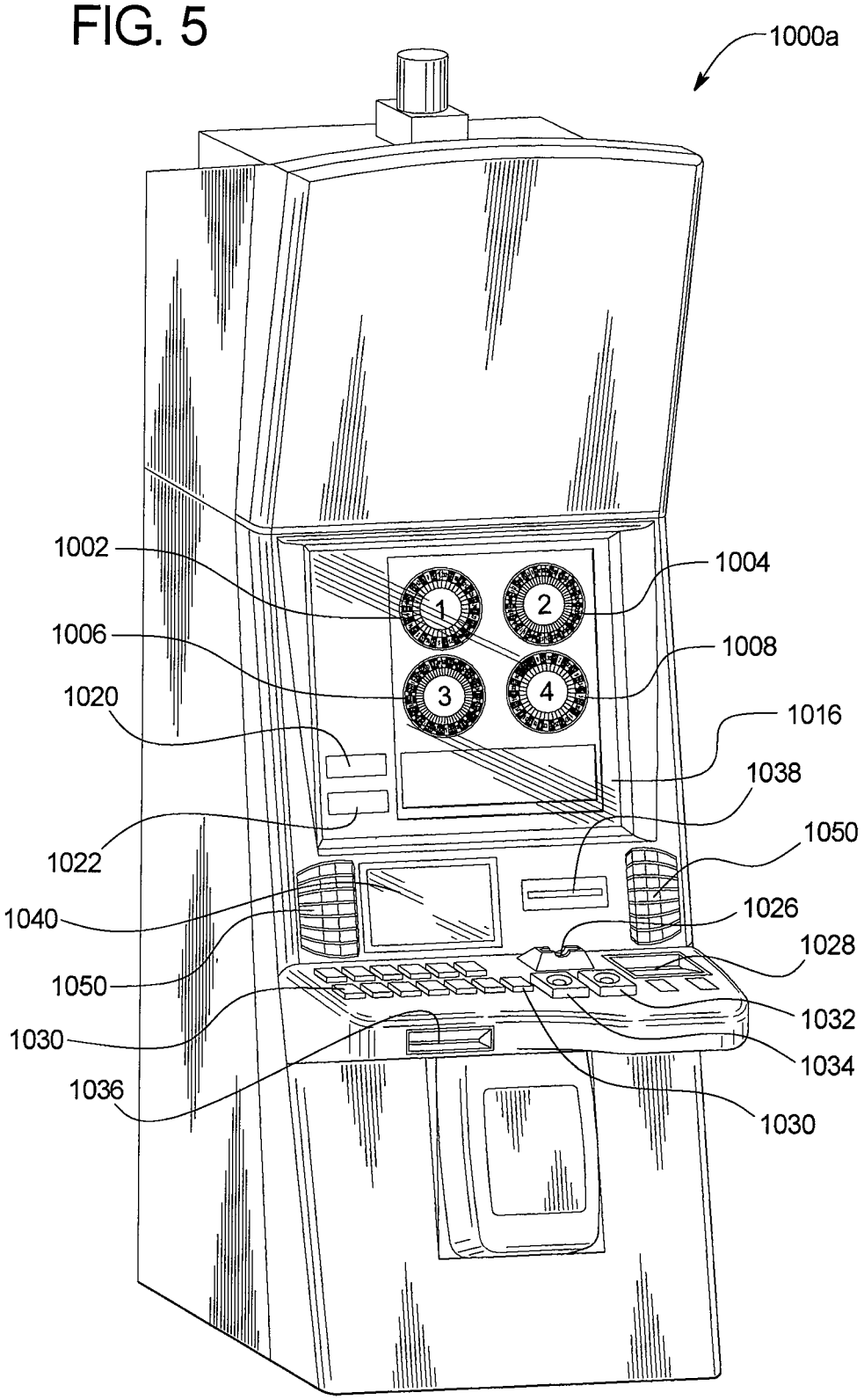
FIG. 5 is a perspective of an electronic gaming device of another embodiment of the present disclosure configured to provide a roulette primary game with four different selectable roulette wheels.

Referring now to FIG. 5, another example embodiment of the present disclosure that provides a multiple selectable roulette wheel electronic gaming device 1000*a* is generally illustrated. Multiple selectable roulette wheel electronic gaming device 1000*a* has a support structure, housing, or cabinet that provides support for a plurality of displays, inputs, controls, and other features of a conventional gaming device. It is configured so that a player may operate it while standing or sitting. The gaming device may be positioned on a base or stand (not shown) or may be configured as a pub-style tabletop game (not shown) that a player may operate preferably while sitting. Multiple selectable roulette wheel electronic gaming device 1000*a* includes display device 1016 (further described below), which displays a primary game including a plurality of different selectable roulette wheels 1002, 1004, 1006, and 1008 and an individual player wagering station or area (further described below) that enables a player place a wager on the roulette game. It should be appreciated that the quantity of different selectable roulette wheels, the size of the different selectable roulette wheels, the arrangement of the different selectable roulette wheels, and the size and shape of the gaming device may vary in accordance with the present disclosure. In this illustrated embodiment, different selectable roulette wheels 1002, 1004, 1006, and 1008 are respectively labeled 1, 2, 3, and 4.

Figure 6:
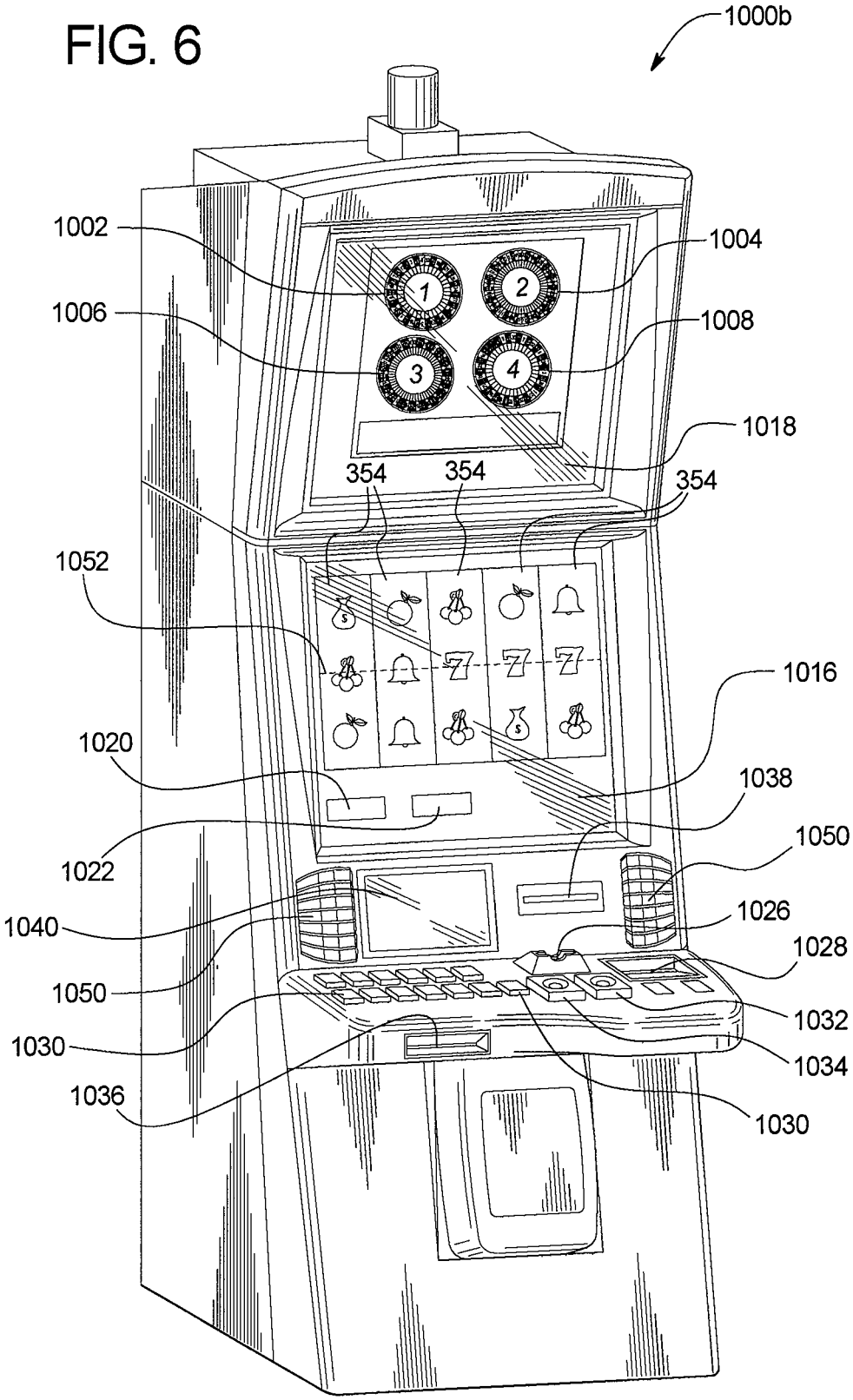
FIG. 6 is a perspective of an electronic gaming device of another embodiment of the present disclosure configured to provide a roulette secondary game with four different selectable roulette wheels.

Referring now to FIG. 6, another example embodiment of the present disclosure that provides a multiple selectable roulette wheel electronic gaming device 1000*b* is generally illustrated. Multiple selectable roulette wheel electronic gaming device 1000*b* includes: has a support structure, housing, or cabinet that provides support for a plurality of displays, inputs, controls, and other features of a conventional gaming device (as further described below). It is configured so that a player may operate it while standing or sitting. The multiple selectable roulette wheel electronic gaming device 1000*b* includes display device 1018 (as further described below) that displays a secondary game including a plurality of different selectable roulette wheels 1002, 1004, 1006, and 1008, and an individual player wagering station or area that enables a player to place at least one wager on the roulette game (as further described below). It should be appreciated that the quantity of roulette wheels, the size of the roulette wheels, the arrangement of the roulette wheels, and the size and shape of the gaming device may vary in accordance with the present disclosure. In this illustrated embodiment, different selectable roulette wheels 1002, 1004, 1006, and 1008, are respectively labeled 1, 2, 3, and 4.

It should be appreciated from the above example embodiments illustrated in FIGS. 1, 2, 3, 4, 5, and 6, that the roulette game of the present disclosure may be implemented in any one of a plurality of different forms. More specifically, the roulette game of the present disclosure may be implemented in: (a) a purely mechanical form; (b) an electro-mechanical form; (c) a part mechanical and part virtual or video form; (d) a purely virtual or video form; or (e) in other suitable forms. The multiple wheel roulette game of the present disclosure may be implemented with: (a) a human dealer; (b) a virtual or video dealer; or (c) no dealer at all. In certain embodiments without a dealer, the play of the roulette game is controlled by one or more processors as further discussed below. Accordingly, it should be appreciated that the roulette game of the present disclosure may be implemented: (a) at a gaming table with a live dealer; (b) at a gaming table with a virtual or a video dealer; (c) through a gaming system with a live dealer and player specific bet stations; (d) through one or more stand alone gaming devices; (e) through a computer network such as the Internet; or (f) in any other suitable manner.

It should also be appreciated that each of the multiple different selectable roulette wheels and the associated wagering stations or areas may be configured for the play of any of the different types of roulette, including, but not limited to, American style roulette, European style roulette, and other suitable variations or styles.

In certain embodiments, one or more of the different selectable roulette wheels includes at least one bonus well. The bonus well may be wider, narrower, or the same width as the other wells. In these embodiments, when a different selectable roulette wheel including a bonus well is selected for a play of the roulette game, the gaming system provides the player or players with a bonus or secondary game when the ball lands in the bonus well. In one example, the bonus or secondary game is a free respin of the roulette game, though it should be appreciated that the bonus or secondary game may be any suitable wagering game.

In the above example embodiments of the present disclosure, the game symbols are represented by numerals; however, it should be appreciated that the game symbols may be displayed as alphanumeric characters or any other suitable characters or images.

In the above example embodiments of the present disclosure, the game symbols are associated with colors red, black, and green. It should be appreciated that one or more of the colors may be another suitable color or indication of a set of wells.

In the above example embodiments of the present disclosure, the game symbols are associated with one or more orders of numbers and colors on each roulette wheel; however, it should be appreciated that the game symbols may be displayed in other suitable orders.

Gaming System Implementations

The present disclosure may be implemented in various configurations for gaming devices or gaming systems, including but not limited to: (1) a dedicated gaming device or gaming system wherein the computerized instructions for controlling any games (which are provided by the gaming device) are provided with the gaming device prior to delivery to a gaming establishment; and (2) a changeable gaming device or gaming system wherein the computerized instructions for controlling any games (which are provided by the gaming device) are downloadable to the gaming device through a data network after the gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 7:
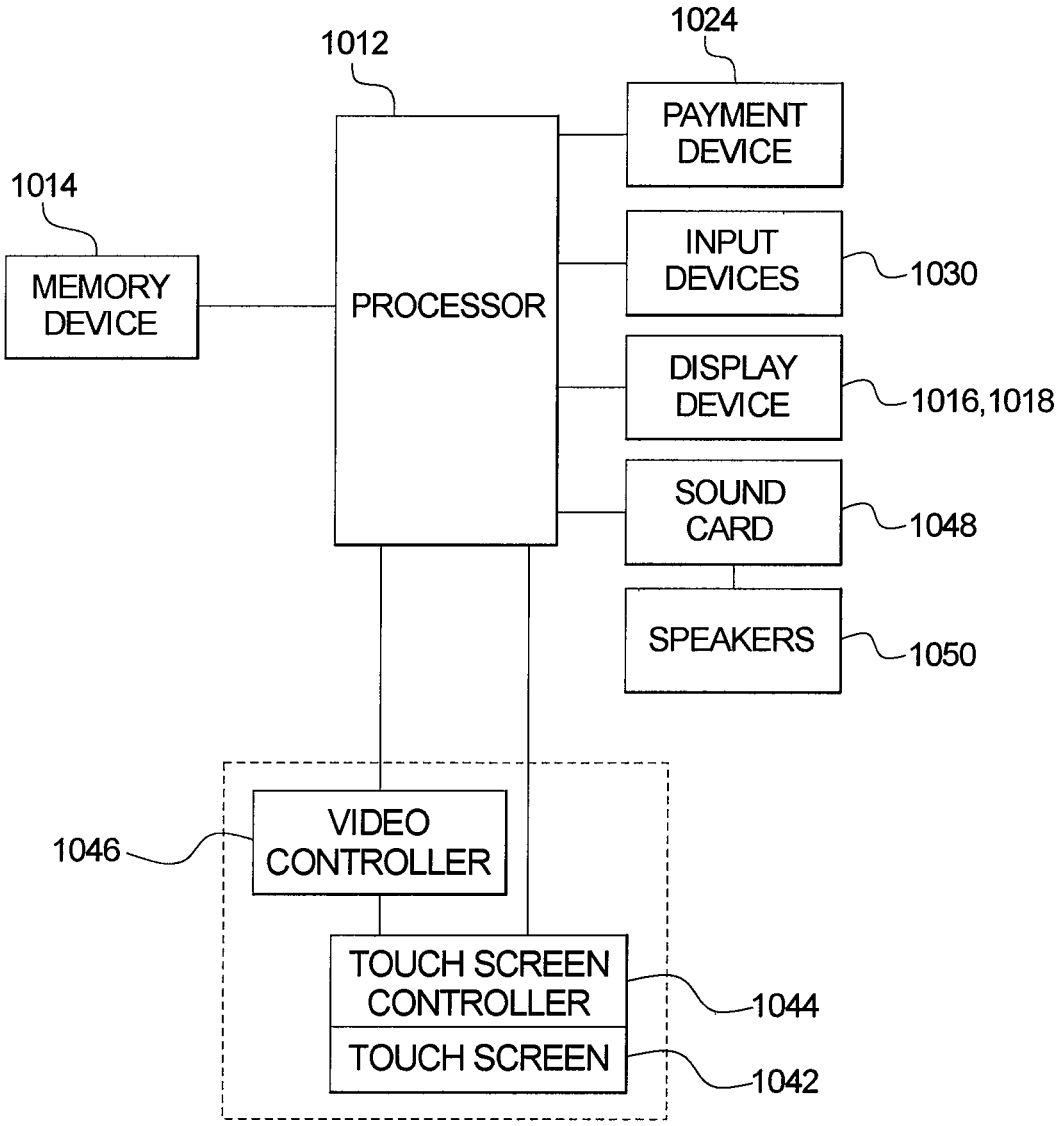
FIG. 7 is a schematic block diagram of one embodiment of an electronic configuration for one of the electronic gaming devices disclosed herein.

In one embodiment, as illustrated in FIG. 7, the gaming device preferably includes at least one processor 1012, such as a microprocessor, a microcontroller-based platform, a suitable integrated circuit or one or more application-specific integrated circuits (ASIC's). The processor is in communication with or operable to access or to exchange signals with at least one data storage or memory device 1014. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which may include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above may be stored in a detachable or removable memory device, including, but not limited to, a suitable cartridge, disk, CD ROM, DVD, or USB memory device. In other embodiments, part or all of the program code and/or operating data described above may be downloaded to the memory device through a suitable network.

In one embodiment, an operator or a player may use such a removable memory device in a desktop computer, a laptop computer, a hand-held device, such as a personal digital assistant (PDA), a portable computing or mobile device, or another computerized platform to implement the present disclosure. In one embodiment, the gaming device disclosed herein is operable over a wireless network, for example as part of a wireless gaming system. In one such embodiment, the gaming device may be a hand-held device, a mobile device, or any other suitable wireless device that enables a player to play any suitable game at a variety of different locations. In various embodiments in which the gaming device is a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It should be appreciated that a gaming device as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 5, the gaming device includes a display device 1016 controlled by the processor. The display devices are preferably connected to or mounted on the cabinet of the gaming device. The embodiment shown in FIG. 5 includes a central display device which displays a primary (roulette wagering) game. This display device may also display any suitable secondary game associated with the primary game as well as information relating to the primary or secondary game. The alternative embodiment shown in FIG. 6 includes a central display device 1016 and an upper display device 1018. The upper display device 1018 may display the primary game, any suitable secondary game associated or not associated with the primary game and/or information relating to the primary or secondary game. In this illustrated embodiment, the multiple wheel roulette game is a secondary game. These display devices may also serve as digital glass operable to advertise games or other aspects of the gaming establishment. As seen in FIGS. 5 and 6, in one embodiment, the gaming device includes a credit display 1020 which displays a player's current number of credits, cash, account balance, or the equivalent. In one embodiment, the gaming device includes a bet display 1022 which displays a player's amount wagered. In one embodiment, as described in more detail below, the gaming device includes a player tracking display 1040 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

As illustrated in FIGS. 5, 6, and 7 in one embodiment, the gaming device includes at least one payment device 1024 in communication with the processor. As seen in FIGS. 5, 6, and 7, a payment device such as a payment acceptor includes a note, ticket or bill acceptor 1028 wherein the player inserts paper money, a ticket, or voucher and a coin slot 1026 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 5, 6, and 7, in one embodiment the gaming device includes at least one and preferably a plurality of input devices 1030 in communication with the processor. The input devices may include any suitable device which enables the player to produce an input signal which is received by the processor. In one embodiment, after appropriate funding of the gaming device, the input device is a game activation device, such as a play button 1032 which is used by the player to start any primary game or sequence of events in the gaming device. The play button may be any suitable play activator such as individual bet buttons, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a cash out button 1034. The player may push the cash out button and cash out to receive a cash payment or other suitable form of payment corresponding to the number of remaining credits. In one embodiment, when the player cashes out, a payment device, such as a ticket, payment, or note generator 1036 prints or otherwise generates a ticket or credit slip to provide to the player. The player receives the ticket or credit slip and may redeem the value associated with the ticket or credit slip, via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 7, one input device is a touch-screen 1042 coupled with a touch-screen controller 1044 or some other touch-sensitive display overlay to allow for player interaction with the images on the display. The touch-screen and the touch-screen controller are connected to a video controller 1046. A player may make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIGS. 5, 6, and 7, the gaming device includes a sound generating device controlled by one or more sounds cards 1048 which function in conjunction with the processor. In one embodiment, the sound generating device includes at least one and preferably a plurality of speakers 1050 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming device may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

In one embodiment, in addition to winning credits or other awards in a base or primary game, the gaming device may also give players the opportunity to win credits in a bonus or secondary game or in a bonus or secondary round. In one embodiment, the triggering event or qualifying condition for the bonus or secondary may be a selected outcome in the primary game or a particular arrangement of one or more indicia on a display device in the primary game. In other embodiments, the triggering event or qualifying condition occurs based on exceeding a certain amount of game play (such as number of games, number of credits, amount of time), or reaching a specified number of points earned during game play.

In another embodiment, the gaming device processor 1012 or central controller 1056 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must place a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 8:
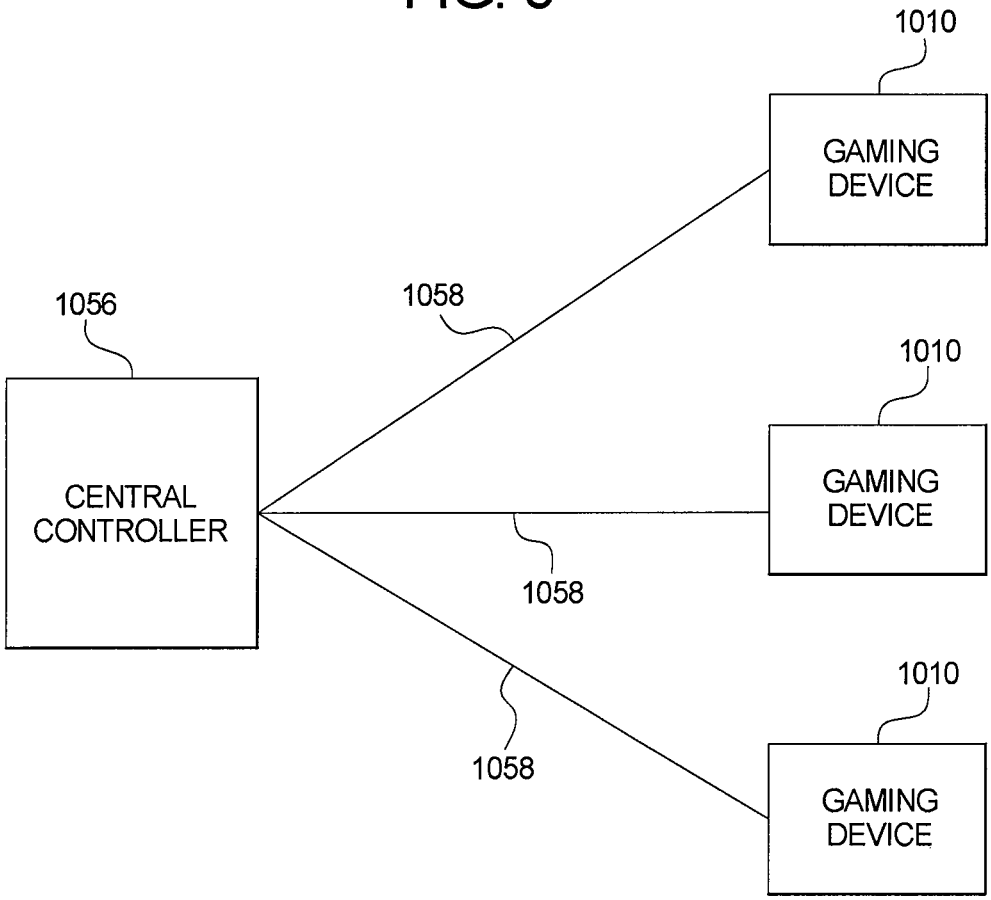
FIG. 8 is a schematic block diagram of one embodiment of a network configuration for a plurality of the electronic gaming devices disclosed herein.

In one embodiment, as illustrated in FIG. 8, one or more of the gaming devices 1000*a* and 1000*b* are in communication with each other and/or at least one central controller 1056 through a data network or remote communication link 1058. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is configured to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome may include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player is also determined by the central server or controller and communicated to the initiated gaming device to be presented or displayed to the player. Central production or control may assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination may be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 1038 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 1040. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an Internet or intranet. In this embodiment, the operation of the gaming device may be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming device in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming device may trigger a progressive award win. In another embodiment, a central server (or the progressive gaming system host site computer) determines when a progressive award win is triggered. In another embodiment, an individual gaming device and a central controller (or progressive gaming system host site computer) work in conjunction with each other to determine when a progressive win is triggered, for example through an individual gaming device meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming devices in the gaming system, via a gaming establishment or via any suitable manner.

In another embodiment, one or more of the progressive awards are partially funded via a side-bet or side-wager which the player may place (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming device. In another embodiment, no minimum wager level is required for a gaming device to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

It should be understood that various changes and modifications to the presently preferred embodiments described herein will be apparent to those skilled in the art. Such changes and modifications may be made without departing from the spirit and scope of the present subject matter and without diminishing its intended advantages. It is therefore intended that such changes and modifications be covered by the appended claims.

The invention claimed is:

1. A gaming system comprising:

at least one input device;

at least one display device;

at least one processor; and at least one memory device storing a plurality of instructions which, when executed by the at least one processor, cause the at least one processor to operate with the at least one input device and the at least one display device, for a play of a roulette game, to:

(a) display a plurality of different roulette wheels, each of the different roulette wheels having a plurality of different outcomes;

(b) enable a player to place at least one wager on said play of the roulette game without indicating which of the plurality of different roulette wheels the at least one wager is associated with;

(c) select only a single one of the different roulette wheels;

(d) after receipt of the at least one wager, indicate to the player which of the different roulette wheels was selected for association with the at least one wager;

(e) display said play of the roulette game using the selected roulette wheel, said play of the roulette game including an indication of one the outcomes of the selected roulette wheel; and (f) provide any awards based on the at least one wager and only on the indicated outcome of the single selected roulette wheel.

2. The gaming system of claim 1, wherein for said play of the roulette game, the selection of one of the different roulette wheels occurs before receipt of the at least one wager.

3. The gaming system of claim 1, wherein for said play of the roulette game, the selection of one of the different roulette wheels occurs after receipt of the at least one wager.

4. The gaming system of claim 1, wherein at least two of the different roulette wheels have a same quantity of different outcomes.

5. The gaming system of claim 1, wherein each of the different roulette wheels has a same quantity of different outcomes.

6. The gaming system of claim 1, wherein at least two of the different roulette wheels have a different quantity of different outcomes.

7. The gaming system of claim 1, wherein at least two of the different roulette wheels have a different quantity of: (i) red wells, (ii) black wells, (iii) numbered wells, (iv) even numbered wells, or (v) odd numbered wells.

8. The gaming system of claim 1, wherein at least two of the different roulette wheels have differently sized: (i) red wells, (ii) black wells, (iii) numbered wells, (iv) even numbered wells, or (v) odd numbered wells.

9. The gaming system of claim 1, wherein at least one of the outcomes of at least one of the different roulette wheels is an alternative function outcome.

10. The gaming system of claim 9, wherein the alternative function outcome is one of: (a) a bonus outcome that provides a predetermined static bonus award; (b) a bonus outcome that provides a progressive bonus award; (c) a bonus outcome that provides a bonus game that may result in a bonus award, where the bonus game includes one or more random determinations of the bonus award; (d) a bonus outcome that provides a bonus game that may result in a bonus award, where the bonus game includes player inputs for determining the bonus award; and (e) a spin again outcome that provides one or more re-spins or additional spins of the roulette wheel without requiring the player to place any additional wagers.

11. The gaming system of claim 1, wherein the selection of one of the different roulette wheels for said play of the roulette game is a random selection.

12. The gaming system of claim 11, wherein each of the different roulette wheels has a same probability of being randomly selected.

13. The gaming system of claim 1, wherein each of the different roulette wheels has a same probability of being selected.

14. The gaming system of claim 1, wherein the different roulette wheels are used for a plurality of plays of the roulette game.

15. The gaming system of claim 1, wherein the different roulette wheels are used for each play of the roulette game.

16. The gaming system of claim 1, wherein the different roulette wheels are a subset of a larger plurality of different roulette wheels.

17. The gaming system of claim 1, wherein each of the at least one wager has a likelihood of greater than zero percent of paying out for said play of the roulette game, regardless of the selected roulette wheel.

18. The gaming system of claim 1, wherein, for each of at least one of the different roulette wheels, one of the outcomes of said roulette wheel associated with one color has a higher chance of being indicated than another one of the outcomes of said roulette wheel associated with another color.

19. The gaming system of claim 1, wherein, for each of at least one of the different roulette wheels, one of the outcomes of said roulette wheel associated with one number has a higher chance of being indicated than another one of the outcomes of said roulette wheel associated with another number.

20. A gaming system comprising:

a gaming table including a frame and one or more legs supporting the frame;

a plurality of different roulette wheels supported by the gaming table, each of the different roulette wheels having a plurality of different outcomes;

a wagering station supported by the gaming table that enables a player to place at least one wager associated with the different outcomes for a play of a roulette game without indicating which of the different roulette wheels the at least one wager is associated with; and an indicator supported by the gaming table configured to, after the at least one wager is placed for said play of the roulette game, indicate only a single selected one of the different roulette wheels for said play of the roulette game, the single selected roulette wheel being associated with the at least one wager and only the single selected roulette wheel being used for said play of the roulette game.

21. The gaming system of claim 20, wherein at least two of the different roulette wheels have a same quantity of different outcomes.

22. The gaming system of claim 20, wherein each of the different roulette wheels has a same quantity of different outcomes.

23. The gaming system of claim 20, wherein at least two of the different roulette wheels have a different quantity of different outcomes.

24. The gaming system of claim 20, wherein at least two of the different roulette wheels have a different quantity of: (i) red wells, (ii) black wells, (iii) numbered wells, (iv) even numbered wells, or (v) odd numbered wells.

25. The gaming system of claim 20, wherein at least two of the different roulette wheels have differently sized: (i) red wells, (ii) black wells, (iii) numbered wells, (iv) even numbered wells, or (v) odd numbered wells.

26. The gaming system of claim 20, wherein at least one of the outcomes of at least one of the different roulette wheels is an alternative function outcome.

27. The gaming system of claim 26, wherein the alternative function outcome is one of: (a) a bonus outcome which provides a predetermined static bonus award; (b) a bonus outcome that provides a progressive bonus award; (c) a bonus outcome that provides a bonus game that may result in a bonus award, where the bonus game includes one or more random determinations of the bonus award; (d) a bonus outcome that provides a bonus game that may result in a bonus award, where the bonus game includes player inputs for determining the bonus award; and (e) a spin again outcome that provides one or more re-spins or additional spins of the roulette wheel without requiring the player to place any additional wagers.

28. The gaming system of claim 20, which includes at least one processor that selects one of the different roulette wheels for said play of the roulette game and causes the indicator to indicate the selected roulette wheel for said play of the roulette game.

29. The gaming system of claim 28 wherein each of the different roulette wheels has a same probability of being selected.

30. The gaming system of claim 20, wherein each of the at least one wager has a likelihood of greater than zero percent of paying out for said play of the roulette game, regardless of the selected roulette wheel for said play of the roulette game.

31. The gaming system of claim 20, wherein, for each of at least one of the different roulette wheels, one of the outcomes of said roulette wheel associated with one color has a higher chance of being indicated during said play of the roulette game than another one of the outcomes of said roulette wheel associated with another color.

32. The gaming system of claim 20, wherein, for each of at least one of the different roulette wheels, one of the outcomes of said roulette wheel associated with one number has a higher chance of being indicated during said play of the roulette game than another one of the outcomes of said roulette wheel associated with another number.

33. A gaming system comprising:

at least one input device;

at least one display device;

at least one processor; and at least one memory device storing a plurality of instructions which, when executed by the at least one processor, cause the at least one processor to operate with the at least one input device and the at least one display device, for a play of a roulette game, to:

(a) enable a player to place at least one wager on said play of the roulette game without indicating which of a plurality of roulette wheels the at least one wager is associated with;

(b) after receipt of the at least one wager, determine at least one roulette wheel based on the at least one wager;

(c) select only a single one of the plurality of roulette wheels, the plurality of roulette wheels including said determined at least one roulette wheel, each of the plurality of roulette wheels including a plurality of different outcomes;

(d) indicate which of the plurality of roulette wheels was selected for association with the at least one wager;

(e) display said play of the roulette game using said selected roulette wheel, said play of the roulette game including an indication of one the outcomes of said selected roulette wheel; and (f) provide any awards based on the at least one wager and only on the indicated outcome of the single selected roulette wheel.

34. The gaming system of claim 33, wherein said determined at least one roulette wheel is configured such that, if selected for said play of the roulette game, each of the at least one wager has a likelihood of greater than zero percent of paying out for said play of the roulette game.

35. The gaming system of claim 33, wherein said determined at least one roulette wheel is configured such that, if selected for said play of the roulette game, an outcome associated with at least one of the player's wagers has an increased probability of being indicated for said play of the roulette game.

36. The gaming system of claim 33, wherein the at least one wager includes a first wager and a second wager, and said determined at least one roulette wheel is configured such that, if selected for said play of the roulette game, an outcome associated with the first wager has an increased probability of being indicated and an outcome associated with the second wager has a decreased probability of being indicated for said play of the roulette game.

37. The gaming system of claim 33, wherein:

(a) the at least one wager includes a first wager and a second wager;

(b) said determined at least one roulette wheel includes a first determined roulette wheel and a second determined roulette wheel;

(c) said first determined roulette wheel is configured such that, if selected for said play of the roulette game, an outcome associated with the first wager has an increased probability of being indicated for said play of the roulette game; and (d) said second determined roulette wheel is configured such that, if selected for said play of the roulette game, an outcome associated with the second wager has a decreased probability of being indicated for said play of the roulette game.

* * * * *